US010671008B2

(12) United States Patent
Zensai et al.

(10) Patent No.: US 10,671,008 B2
(45) Date of Patent: Jun. 2, 2020

(54) DRIVE TRANSMITTING MEMBER, DRIVE TRANSMITTING DEVICE, AND IMAGE FORMING APPARATUS

(71) Applicant: CANON KABUSHIKI KAISHA, Tokyo (JP)

(72) Inventors: Shoichi Zensai, Yokohama (JP); Takamichi Matsuo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/122,547

(22) Filed: Sep. 5, 2018

(65) Prior Publication Data

US 2019/0079446 A1 Mar. 14, 2019

(30) Foreign Application Priority Data

Sep. 13, 2017 (JP) ..... 2017-175395
Jun. 11, 2018 (JP) ..... 2018-111277

(51) Int. Cl.

| | |
|---|---|
| ***G03G 15/00*** | (2006.01) |
| ***G03G 21/18*** | (2006.01) |
| ***G03G 15/08*** | (2006.01) |
| ***G03G 15/16*** | (2006.01) |

(52) U.S. Cl.

CPC ..... *G03G 15/757* (2013.01); *G03G 15/0806* (2013.01); *G03G 15/161* (2013.01); *G03G 15/1615* (2013.01); *G03G 15/5008* (2013.01); *G03G 21/186* (2013.01); *G03G 2215/1657* (2013.01)

(58) Field of Classification Search

None

See application file for complete search history.

(56) References Cited

U.S. PATENT DOCUMENTS 7,564,473 B2 * 7/2009 Nomura ..... G03G 15/161 347/234
2012/0121294 A1 * 5/2012 Kamimura ..... G03G 21/186 399/167

FOREIGN PATENT DOCUMENTS

JP 2-142959 A 6/1990
JP 2004-109671 A 4/2004
JP 2008-25643 A 2/2008

OTHER PUBLICATIONS

JP_02142959_A_T MachineTranslation, Japan, Kato, 1990.*

* cited by examiner

*Primary Examiner* — Victor Verbitsky
(74) *Attorney, Agent, or Firm* — Canon U.S.A. Inc., IP Division

(57) ABSTRACT

A drive transmitting member including: a gear portion that is formed of a first resin and has gear teeth; and a flange portion that is formed of a second resin, in which the flange portion includes a shaft portion that transmits driving force from the gear teeth to a drive transmitted member, and a rotation stopper (i) that stops rotation of the gear portion with respect to the flange portion at an outer periphery of the flange portion and (ii) that is larger than an external form of the shaft portion, so that the shaft portion and the rotation stopper are integrally molded in the flange portion, and the gear portion has a shape that covers the rotation stopper and is not overlapped with the shaft portion as viewed in an axial direction of the shaft portion.

19 Claims, 25 Drawing Sheets

DRIVE TRANSMITTING MEMBER, DRIVE TRANSMITTING DEVICE, AND IMAGE FORMING APPARATUS

BACKGROUND OF THE INVENTION

Field of the Invention

The present disclosure relates to a drive transmitting member formed of resin, a drive transmitting device including the drive transmitting member, and an image forming apparatus including the drive transmitting device.

Description of the Related Art

As a conventional image forming apparatus, there is an image forming apparatus having an inline configuration that includes a plurality of image carrying members and a plurality of process units (a charging unit, a developing unit, a cleaning unit, and the like) acting thereon and includes one belt capable of contacting the respective image carrying members, and is capable of forming a color image on a transfer material.

From a viewpoint of image quality, in order to stably layer developer of yellow, magenta, cyan, and black, rotation non-uniformity of the image carrying members needs to be reduced with respect to a load variation during conveyance of the transfer material or a load variation due to presence or absence of developer. Thus, a gear with a relatively large diameter or a gear whose rigidity is high is widely adopted for the purpose of reducing rotation non-uniformity of gear tooth pitch.

Japanese Patent Laid-Open No. 2008-25643 proposes a configuration in which a metal gear is formed by insert molding in a resin gear. Specifically, in a gear having a substantially concave hole, a separate pinion gear is formed by insert molding.

Japanese Patent Laid-Open No. 2004-109671 proposes a configuration in which a drive shaft is inserted in a rotation transmitting member, which drives an image carrying member, for integral molding. Specifically, the metal drive shaft is formed by insert molding in a timing pulley or gear that is formed of resin and receives rotation from a driving motor.

Japanese Patent Laid-Open No. 2-142959 proposes a gear in which a gear portion that has tooth profiles formed in an outer periphery thereof and is formed in an annular shape by a soft material and a bearing portion that has a hole portion, to which a support shaft is attached, formed at a center thereof and is formed almost in a circular plate shape by a soft material are concentrically and integrally formed by insert molding. The gear described in Japanese Patent Laid-Open No. 2-142959 does not transmit drive to the support shaft attached to the hole portion.

In an image forming apparatus, polyacetal (POM) resin is widely used, in particular, as a material of a timing pulley or a gear from a viewpoint of abrasion resistance. On the other hand, a metal shaft such as a steel bar is used for a drive shaft in many cases to ensure torsional rigidity. Additionally, engineering plastics such as polyethylene terephthalate (PET) resin, polybutylene terephthalate (PBT) resin, or polyphenylene sulfide (PPS) resin may be used for the drive shaft.

In a case where a drive transmitting member is manufactured through two-color molding by combining such resin, residual strain is caused when a resin temperature at the time of molding is reduced to a normal temperature to cause shrinkage due to a difference between linear expansion coefficients of the resin. Moreover, since polyacetal resin is crystalline resin, the shrinkage further advances in a process where internal crystallization advances.

In the configuration of Japanese Patent Laid-Open No. 2008-25643, a rim surface is at an end of the gear in a tooth width direction in a section of the gear taken along a direction orthogonal to a metal shaft. Thus, in a case where the gear shrinks relatively to the shaft, residual strain is caused due to a difference of internal stress between a part with the rim surface and a part without the rim surface in the tooth width direction of the gear. Then, depending on a use environment, the gear is deformed due to creep (phenomenon), which may result in rotation non-uniformity of an image carrying member at last.

In Japanese Patent Laid-Open No. 2004-109671, the metal drive shaft is subjected to knurling and the resultant is used as a timing pulley serving as a rotation transmitting member or a rotation stopper of a gear. Thus, driving force is transmitted at a place where a radius of rotation is relatively small so that great stress acts on the rotation stopper (knurling portion of the drive shaft) at the time of transmission of the drive. As a result, there is a possibility that deformation or slip of the rotation stopper occurs and image quality may be lowered due to an increase in non-uniformity of the image carrying member.

SUMMARY OF THE INVENTION

The disclosure provides a drive transmitting member including: a gear portion that is formed of a first resin and has gear teeth; and a flange portion that is formed of a second resin, in which the flange portion includes a shaft portion that transmits driving force from the gear teeth to a drive transmitted member, and a rotation stopper (i) that stops rotation of the gear portion with respect to the flange portion at an outer periphery of the flange portion and (ii) that is larger than an external form of the shaft portion, so that the shaft portion and the rotation stopper are integrally molded in the flange portion, and the gear portion has a shape that covers the rotation stopper and is not overlapped with the shaft portion as viewed in an axial direction of the shaft portion.

Further features of the present disclosure will become apparent from the following description of exemplary embodiments with reference to the attached drawings.

DESCRIPTION OF THE EMBODIMENTS

Desirable embodiments of the disclosure will be exemplarily described in detail below with reference to the drawings. Note that, dimensions, materials, shapes, and relative arrangement of components described in the following embodiments are to be appropriately changed in accordance with a configuration of an apparatus to which the disclosure is applied and various conditions. Thus, the disclosure is not intended to be limited to the following embodiments, unless otherwise specifically stated.

Embodiment 1

An image forming apparatus including a drive transmitting device according to the present embodiment will be described below. Here, a printer to which a process cartridge as a unit is detachably attachable will be exemplarily described as the image forming apparatus.

[Entire Configuration of Image Forming Apparatus]

Figure 1A:
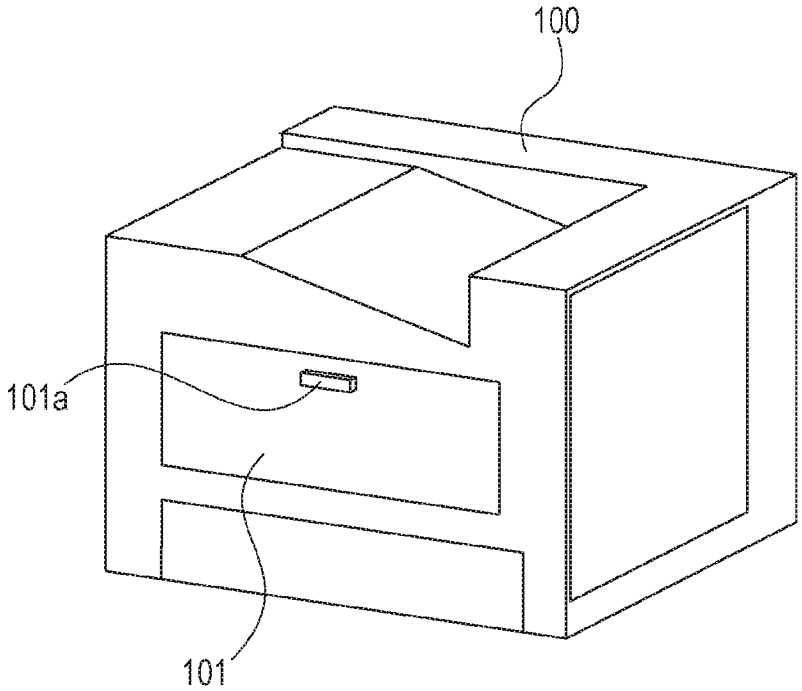
FIGS. 1A and 1B are schematic perspective views of an image forming apparatus of Embodiment 1.
Figure 1B:
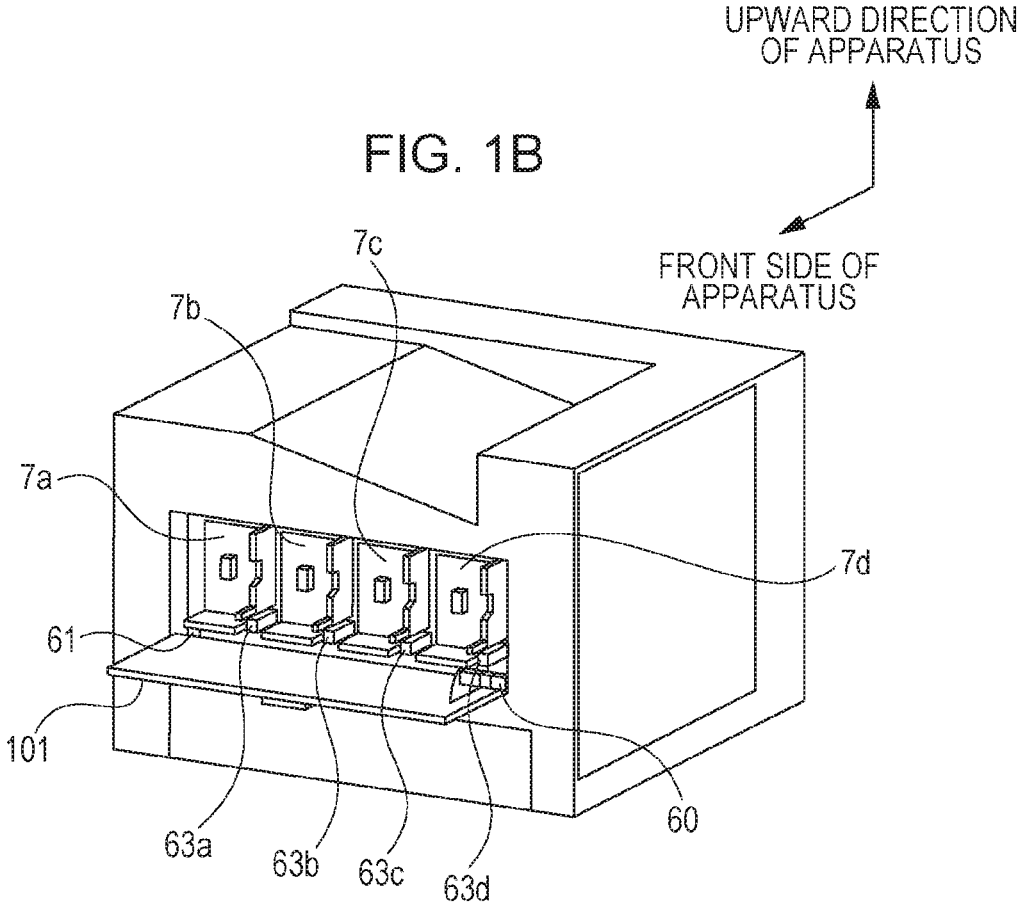
Figure 2:
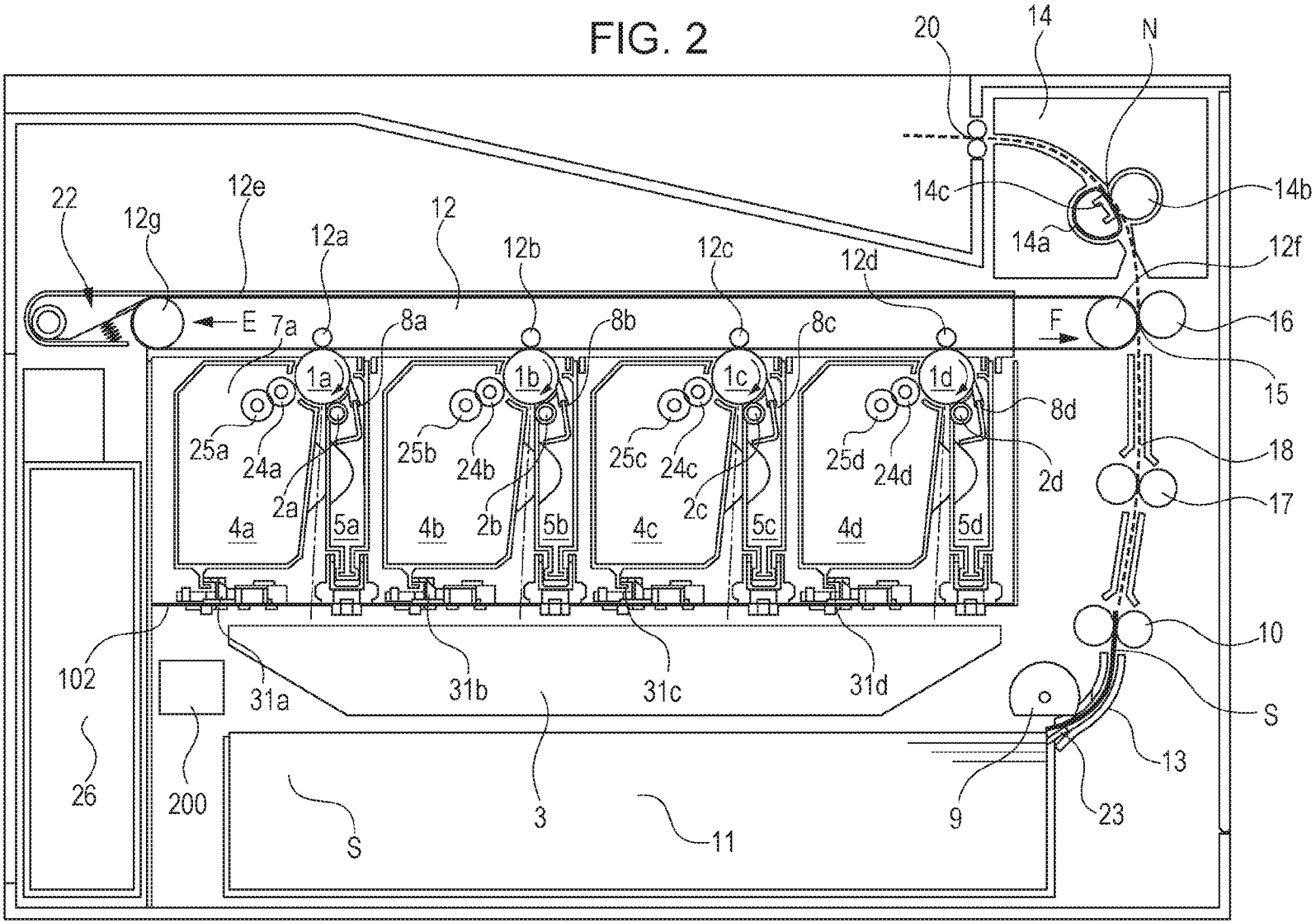
FIG. 2 is a schematic sectional view of the image forming apparatus of Embodiment 1.

FIGS. 1A and 1B are perspective views of an image forming apparatus (printer 100). FIG. 1A is a view of the image forming apparatus in a state where an access door 101 of a process cartridge 7 is closed and FIG. 1B is a view of the image forming apparatus in a state where the access door 101 is opened. When the access door 101 is opened, the process cartridge 7 is able to be pulled out in a front side direction of the apparatus. FIG. 2 is a schematic sectional view of the image forming apparatus (printer 100). Here, the front of the image forming apparatus is set as a front side of the apparatus and the back of the image forming apparatus opposite to the front of the apparatus is set as a back side of the apparatus. An upper side of the image forming apparatus is set as an upward direction of the apparatus and a lower side of the image forming apparatus opposite to the upper side of the apparatus is set as a downward direction of the apparatus. A direction orthogonal to a front-rear direction of the apparatus is set as a vertical direction of the apparatus and a direction orthogonal to the front-rear direction of the apparatus and the vertical direction of the apparatus is set as a horizontal direction of the apparatus. Note that, the horizontal direction of the apparatus is also a direction in which four process cartridges described below are arranged and a direction in which an intermediate transfer belt rotationally moves.

As illustrated in FIGS. 1A, 1B, and 2, a cassette 11 is housed in a lower part of the printer 100 so that the cassette 11 is able to be pulled out therefrom. In the cassette 11, each transfer material (for example, a recording sheet, a plastic sheet, cloth, etc.) S is stacked and stored and each transfer material S is separated and fed one by one. As image forming units configured to be arranged side by side in a row, process cartridges 7*a*, 7*b*, 7*c*, and 7*d* (process cartridge 7) respectively corresponding to colors of yellow (Y), magenta (M), cyan (C), and black (K) are provided in the printer 100 so as to be detachably attachable. In the process cartridge 7, photosensitive drums 1*a*, 1*b*, 1*c*, and 1*d* (photosensitive drum 1) serving as image carrying members and process units configured to act on the photosensitive drum 1 are arranged. Here, as the process units, charging devices (charging units) 2*a*, 2*b*, 2*c*, and 2*d* that uniformly and negatively charge a surface of the photosensitive drum 1 are arranged. As the process units, development units (developing unit) 4*a*, 4*b*, 4*c*, and 4*d* that cause toner to be bonded to electrostatic latent images to develop the images as toner images are arranged. Additionally, as the process units, cleaning blades (cleaning units) 8*a*, 8*b*, 8*c*, and 8*d* that remove residual toner remaining on the photosensitive drum 1 are arranged. The process cartridge 7 is constituted by a cleaner unit 5 (5*a*, 5*b*, 5*c*, and 5*d*) and a development unit 4 (4*a*, 4*b*, 4*c*, and 4*d*). The cleaner unit 5 has the photosensitive drum 1, the charging device 2, the cleaning blade 8, and a toner container in which toner removed by the cleaning blade 8 is stored. The development units 4 rotatably support development rollers 24*a*, 24*b*, 24*c* and 24*d* and developer applying rollers 25*a*, 25*b*, 25*c*, and 25*d*.

Figure 3A:
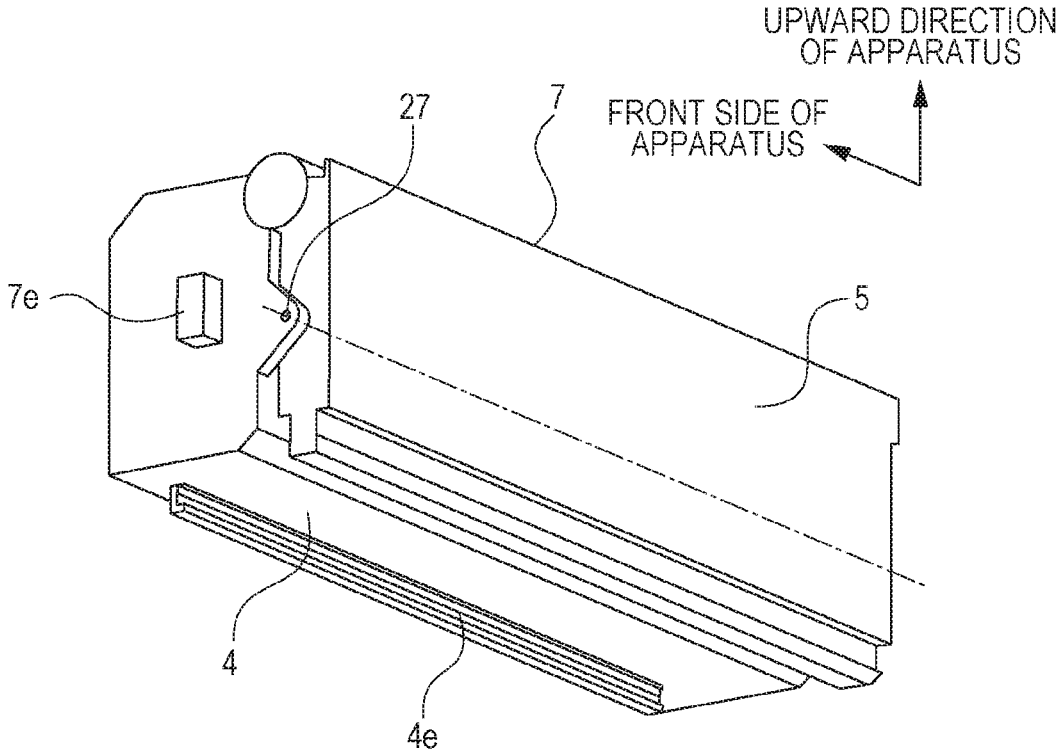
FIGS. 3A and 3B are schematic perspective views of a process cartridge of Embodiment 1.
Figure 3B:
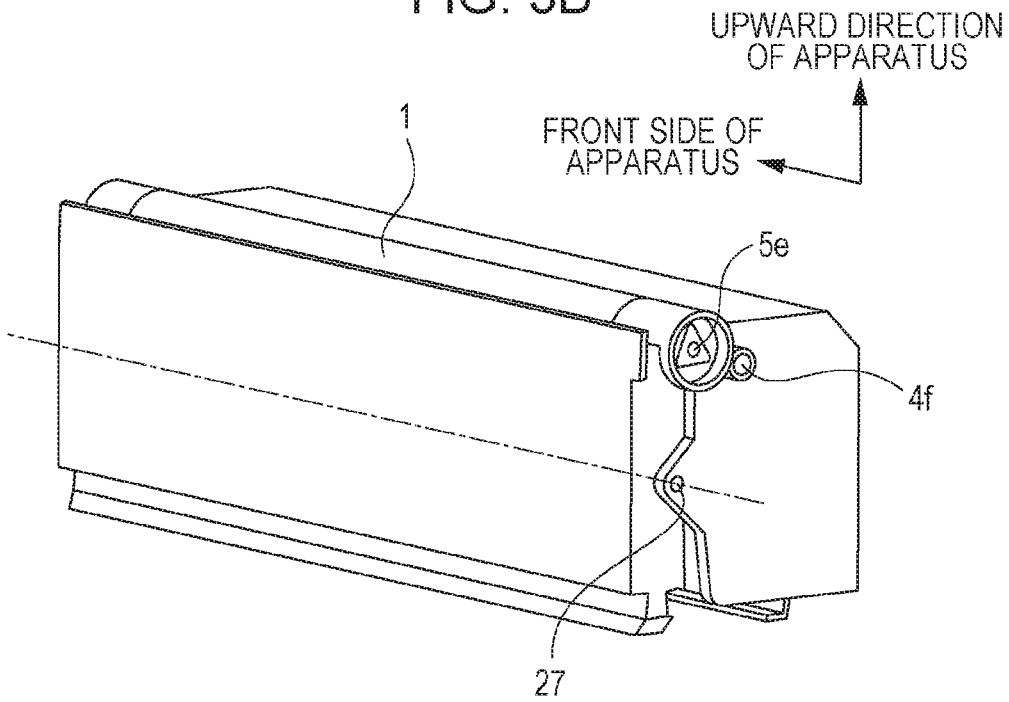

FIGS. 3A and 3B are perspective views of the process cartridge 7. In the development unit 4, a rib 4*e* in a substantially L-shape is provided in the downward direction of the apparatus and a grip portion 7*e* is provided on the front side of the apparatus. By a development contact-and-separation mechanism to which drive is transmitted from a driving portion 500 (refer to FIG. 5A) described later, a moving member 31 (31*a*, 31*b*, 31*c*, or 31*d*) illustrated in FIG. 2 acts on the rib 4*e*. The development unit 4 is swingable about a pin 27, provided along the front-rear direction of the apparatus, as a rotation center relative to the cleaner unit 5, and the development roller 24 illustrated in FIG. 2 is configured to be capable of coming into and out of contact with the photosensitive drum 1 (movable between a contact position and a separation position). With such a configuration, at a timing when the toner is bonded to the electrostatic latent image formed on the photosensitive drum 1 to develop the image, the development roller 24 is brought into contact with the photosensitive drum 1. In other periods, the development roller 24 is separated from the photosensitive drum 1 as much as possible, so that lifetimes of the development roller 24 and the photosensitive drum 1 are improved. A scanner unit 3 that emits a laser beam on the basis of image information to form the electrostatic latent image on the photosensitive drum 1 is provided below the process cartridge 7 and an intermediate transfer unit 12 is provided above the process cartridge 7.

The intermediate transfer unit 12 includes primary transfer rollers 12*a*, 12*b*, 12*c*, and 12*d*, an intermediate transfer belt 12*e* in a cylindrical endless shape, a driving roller 12*f*, a tension roller 12*g*, and a cleaning device 22 that removes toner on the intermediate transfer belt 12*e*. The cleaning device 22 is disposed upstream of a primary transfer portion formed by the photosensitive drum 1*a* and the primary transfer roller 12*a* with respect to a movement direction (a direction of an arrow F in FIG. 2) of the intermediate transfer belt 12*e*. Also, the cleaning device 22 is disposed downstream of a secondary transfer portion 15 formed by the driving roller 12*f* and a secondary transfer roller 16. Further, the cleaning device 22 is positioned and held by a shaft of the tension roller 12*g*. Thus, the cleaning device 22 is configured to follow a positional fluctuation of the tension roller 12*g*. Moreover, since the intermediate transfer belt 12*e* and the cleaning device 22 are consumables, the intermediate transfer unit 12 integrated with the cleaning device 22 is detachably attachable to an image forming apparatus main body. Further, residual toner on the intermediate transfer belt 12*e*, which is collected by the cleaning device 22, is accumulated in a toner container 26 provided in the printer 100.

The driving roller 12*f* is rotationally driven by a driving source such as a motor (not illustrated), so that the intermediate transfer belt 12*e* rotates at a predetermined speed in the direction of the arrow F in FIG. 2. For primary transfer, positive bias voltages are applied to the primary transfer rollers 12*a*, 12*b*, 12*c*, and 12*d* and a potential difference thereof with the negatively charged surface of the photosensitive drum 1 is used to transfer the toner (primary transfer) onto the intermediate transfer belt 12*e*. The toner images on the photosensitive drum 1 are primary-transferred in a layered manner at primary transfer portions formed by the primary transfer rollers 12*a*, 12*b*, 12*c*, and 12*d* and the photosensitive drum 1. The toner images transferred onto the intermediate transfer belt 12*e* are transferred together onto the transfer material S at the secondary transfer portion 15 formed by the driving roller 12*f* and the secondary transfer roller 16. Thereafter, the transfer material S passes through a fixing device 14 that fixes the transferred images and is conveyed to a discharge roller pair 20 and then is discharged on a transfer material stacking portion.

Here, a feeding device 13 has a feeding roller 9 for feeding the transfer material S from an inside of the feeding cassette 11 in which the transfer material S is accommodated and has a conveying roller pair 10 for conveying the fed transfer material S. Each transfer material S accommodated in the feeding cassette 11 is press-contacted to the feeding roller 9 and separated one by one by a separating pad 23 (friction piece separation type), and conveyed.

Then, the transfer material S fed from the feeding device 13 is conveyed to the secondary transfer portion 15 by a registration roller pair 17. The fixing device 14 fixes the image formed on the transfer material S by applying heat and pressure. A fixing belt 14*a* has a cylindrical shape and is guided by a belt guide member 14*c* to which a heat generating unit such as a heater is bonded. An elastic pressing roller 14*b* forms, together with the belt guide member 14*c*, a fixing nip portion N having a predetermined width under predetermined pressure contact force, with the fixing belt 14*a* interposed therebetween.

The printer 100 has a controller 200 that controls an image forming operation by the printer 100.

[Controller]

Figure 4:
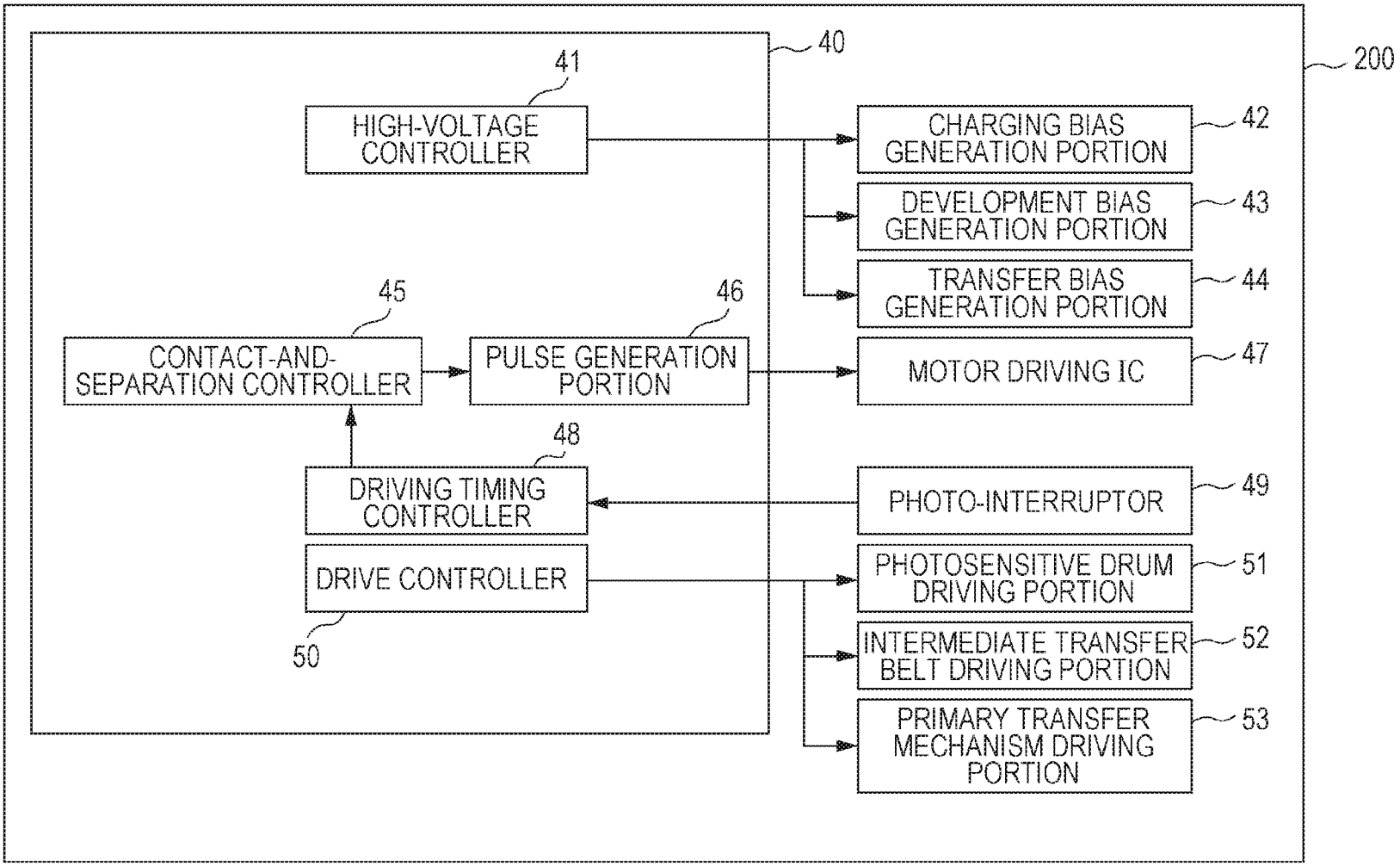
FIG. 4 is a block diagram illustrating a configuration of a controller of the image forming apparatus of Embodiment 1.

Next, the controller 200 will be described. FIG. 4 is a block diagram illustrating a configuration of the controller 200 of the image forming apparatus.

The printer 100 includes the controller 200 in which an electric circuit for performing control of the apparatus is mounted, and a CPU 40 is mounted in the controller 200. The CPU 40 includes a drive controller 50 that controls a driving source for the process cartridge 7 or the like, a high-voltage controller 41 that performs control related to image formation, a contact-and-separation controller 45 that controls contact and separation of the development roller 24, and the like. The CPU 40 collectively controls feeding of the transfer material S and an operation of the image forming apparatus. The drive controller 50 controls, as drive control during image formation, a photosensitive drum driving portion 51, an intermediate transfer belt driving portion 52, and a primary transfer mechanism driving portion 53. The high-voltage controller 41 controls a charging bias generation portion 42, a development bias generation portion 43, and a transfer bias generation portion 44 which generate voltages necessary for the image formation. Further, the controller 200 includes a motor driving IC 47 that controls drive of a contact-and-separation motor 90 (refer to FIG. 5A) or the like of a development contact-and-separation mechanism described later. The CPU 40 transmits a pulse signal (here, an exciting type is set as a two-phase excitation type) to the motor driving IC 47, and thus switches excitation of the contact-and-separation motor 90. The motor driving IC 47 receiving the pulse signal controls a direction of a current flowing through a coil of the contact-and-separation motor 90 in response to the pulse signal and has a mechanism of rotating a rotor magnet by reversing a field magnetic pole in the contact-and-separation motor 90 at that time. Note that, a rotational speed of the contact-and-separation motor 90 depends on a frequency (hereinafter, defined as a drive frequency) of the pulse signal transmitted from the CPU 40, and as the drive frequency is higher, a reverse cyclic period of the field magnetic pole in the contact-and-separation motor 90 is shorter and also the rotational speed of the contact-and-separation motor 90 is faster.

The contact-and-separation controller 45 that controls a timing or the like of the contact and separation controls a pulse generation portion 46 to drive the contact-and-separation motor 90, and the pulse signal generated by the pulse generation portion 46 is transmitted to a motor driving portion (motor driving IC) 47. Moreover, a signal of a photo-interruptor 49 serving as a position detecting sensor described later is transmitted to a driving timing controller 48 and is used for contact-and-separation control.

Next, the driving portion 500 will be described. First, with reference to FIGS. 5A and 5B, a mechanism of switching contact and separation between the development roller 24 and the photosensitive drum 1 will be described.

[Development Contact-and-Separation Mechanism]

Figures 5A, 5B:
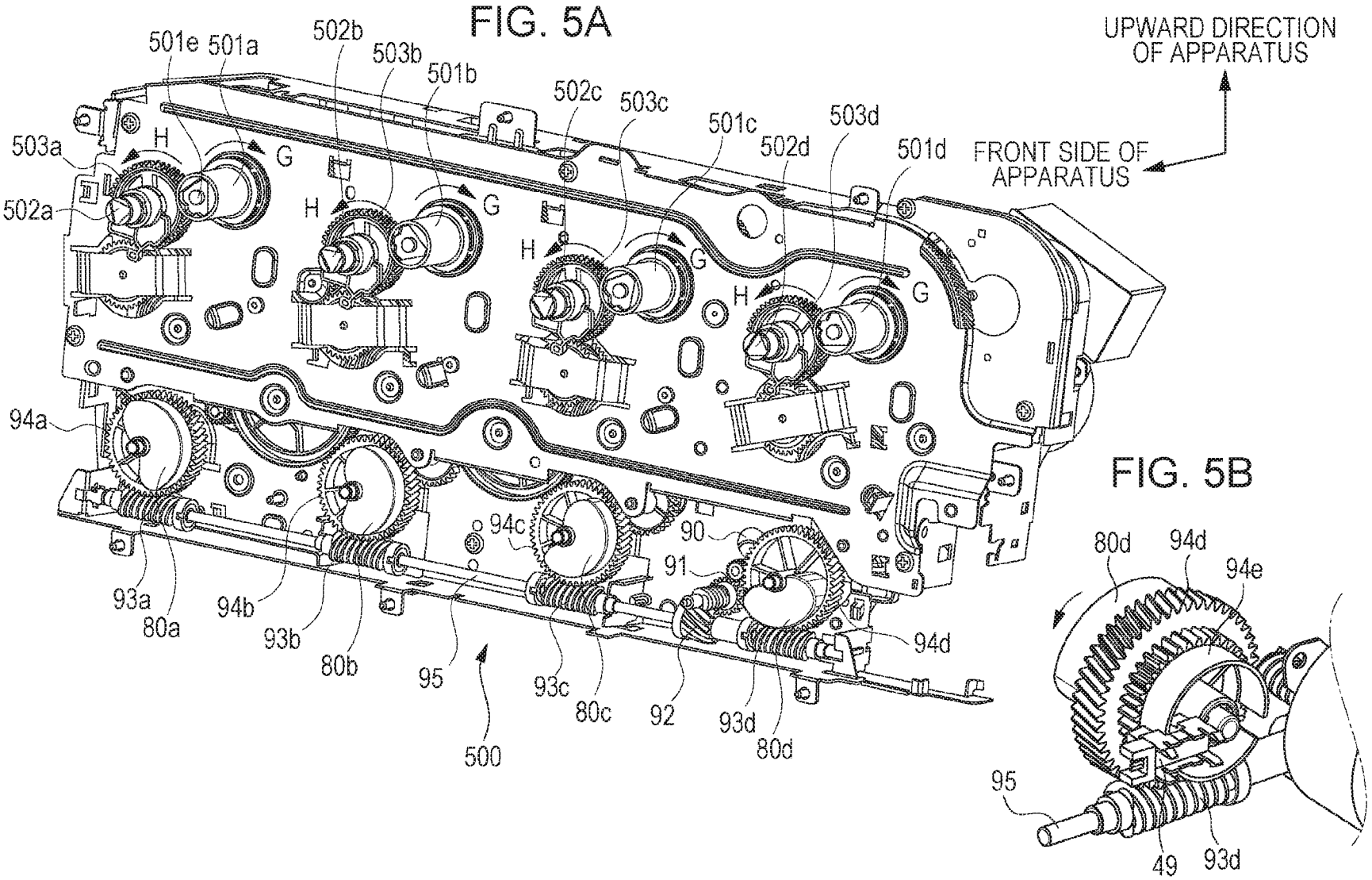
FIG. 5A is a perspective view of a driving portion of Embodiment 1 and FIG. 5B is a perspective view illustrating a relationship between a cam gear and a photo-interruptor.

FIG. 5A is a perspective view illustrating the entire driving portion 500 including the development contact-and-separation mechanism. FIG. 5B is a partial perspective view of a periphery of the photo-interruptor 49 of the driving portion 500 of the development contact-and-separation mechanism. The contact-and-separation motor 90 serving a driving source for switching a position (contact position, separation position) of the developing roller 24 relative to the photosensitive drum 1 uses a stepping motor. The contact-and-separation motor 90 is connected to a drive switching shaft 95 via gears 91 and 92. The drive switching shaft 95 is provided with worm gears 93 (93*a* to 93*d*) that drive cam gears 94 (94*a* to 94*d*) for the respective colors. The drive switching shaft 95 is rotated by rotation of the contact-and-separation motor 90, so that the cam gears 94 are rotated and rotational phases of fours cams 80 (80*a*, 80*b*, 80*c*, and 80*d*) are changed. The cams 80 move the moving member 31 (refer to FIG. 2) in the horizontal direction of the apparatus via a link mechanism (not illustrated). Thereby, positions of the development unit 4 and the development roller 24 are able to be regulated, and the rib 4*e* of the development unit 4 is pressed, so that contact and separation between the photosensitive drum 1 and the development roller 24 are switched.

In this manner, the drive switching shaft 95 and the four cams 80 that are moving members for moving the development roller 24 with respect to the photosensitive drum 1 are rotationally driven by one contact-and-separation motor 90, so that the position (contact position, separation position) of the development roller 24 with respect to the photosensitive drum 1 is made changeable.

As illustrated in FIGS. 3A and 3B, the development unit 4 is rotatable about the pin 27 as a swing center while rotatably supporting the development roller 24, and is urged by an urging unit in a direction in which the development unit 4 contacts the photosensitive drum 1.

[Process Cartridge Drive Train]

Subsequently, a configuration of the drive transmitting device, which drives the process cartridge 7, in the driving portion 500 will be described with reference to FIGS. 5A, 5B, and 6.

The driving portion 500 illustrated in FIG. 5A has drum driving gears 501*a*, 501*b*, 501*c*, and 501*d* and development driving gears 503*a*, 503*b*, 503*c*, and 503*d* correspondingly to respective colors of yellow (Y), magenta (M), cyan (C), and black (K). The development driving gears 503*a* to 503*d* are driving gears for driving the development units 4*a*, 4*b*, 4*c*, and 4*d*. The drum driving gears 501*a* to 501*d* as drive transmitting members are driving gears for driving the cleaner units 5*a*, 5*b*, 5*c*, and 5*d*. Each of drum driving gears 501 (501*a* to 501*d*) has a coupling portion 501*e* that is a concave portion and has a substantially triangle and concave shape at the front side of the apparatus. The coupling portion 501*e* is engaged with a convex shape of a coupling 5*e* of the photosensitive drum 1 serving as a drive transmitted member illustrated in FIG. 3B. Upon such engagement, drive of the drum driving gear 501 is transmitted and the photosensitive drum 1 is driven in a direction of an arrow G indicated with a solid line in FIG. 5A. Similarly, each of development driving gears 503 (503*a* to 503*d*) inputs drive to a coupling 4*f* on a side of the development unit 4 illustrated in FIG. 3B via each of development couplings 502 (502*a* to 502*d*). Each of the development couplings 502 is engaged with the coupling 4*f* that has a substantially triangle shape similarly to the photosensitive drum 1 side and drives the development roller 24 in a direction of an arrow H indicated with a solid line in FIG. 5A.

Figure 6:
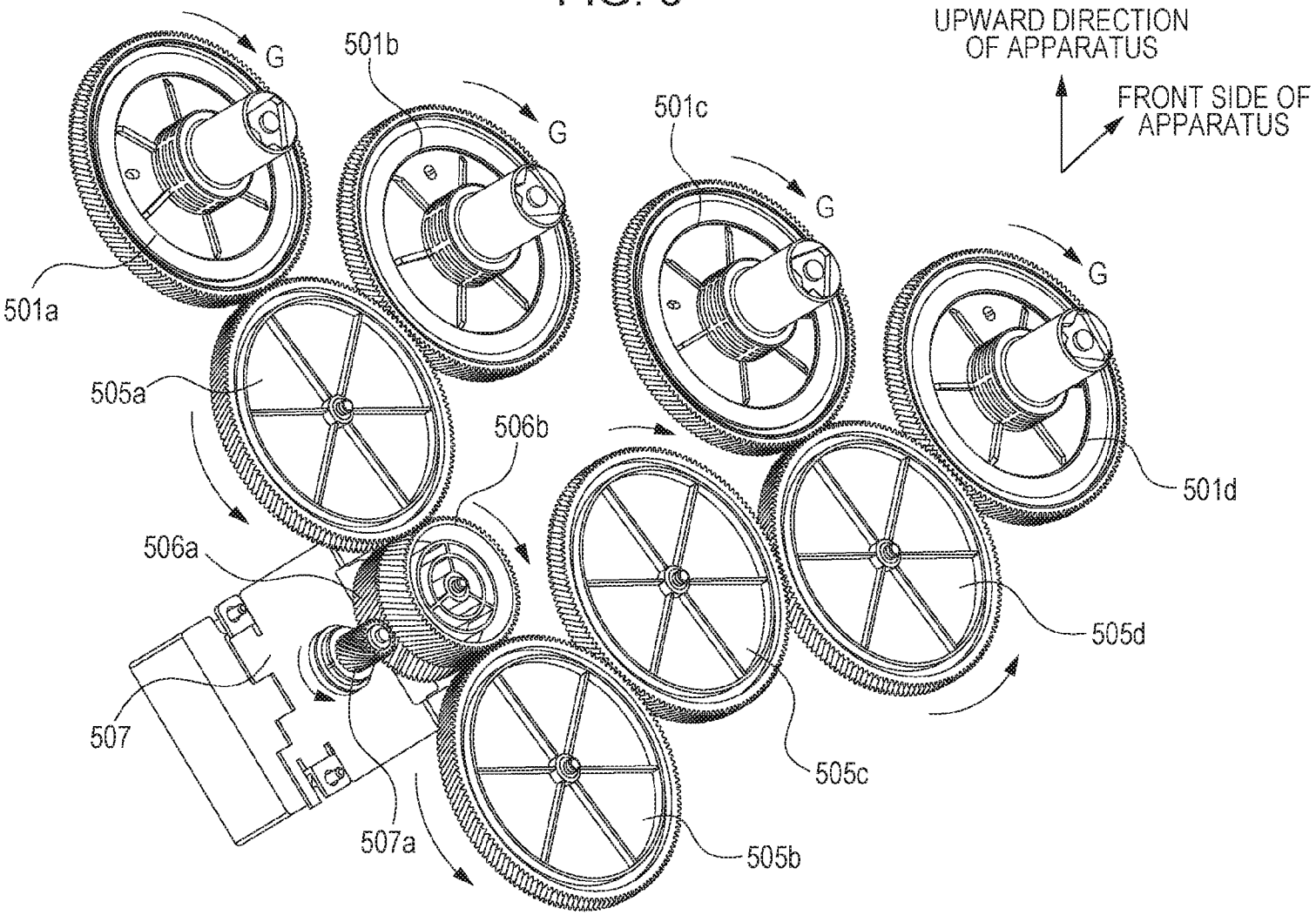
FIG. 6 is a perspective view of a photosensitive drum drive train of Embodiment 1.

FIG. 6 is a perspective view illustrating only a drive train (drive transmitting device) from a motor 507 serving as a driving source for driving the photosensitive drum 1 to the drum driving gear 501 on a drive output side. The motor 507 has a pinon gear 507*a* and the pinion gear 507*a* is fixed to a shaft of the motor 507. The pinon gear 507*a* is engaged with a large gear 506*a* of a stepped gear 506. A small gear 506*b* of the stepped gear 506 is engaged with an idler gear 505*a* and an idler gear 505*b*. To the drum driving gear 501*a* and the drum driving gear 501*b* as the drive transmitting members, drive is transmitted from the idler gear 505*a*. On the other hand, to the drum driving gear 501*c* and the drum driving gear 501*d* as the drive transmitting members, drive is transmitted from the idler gear 505*b* via an idler gear 505*c* and an idler gear 505*d*. In this manner, each of the driving gears (drive transmitting members) receives driving force from the motor 507 and is rotated in each direction of an arrow indicated with a solid line in FIG. 6.

[Decision of Phases of Gears of Photosensitive Drum Drive Train]

Figure 7A:
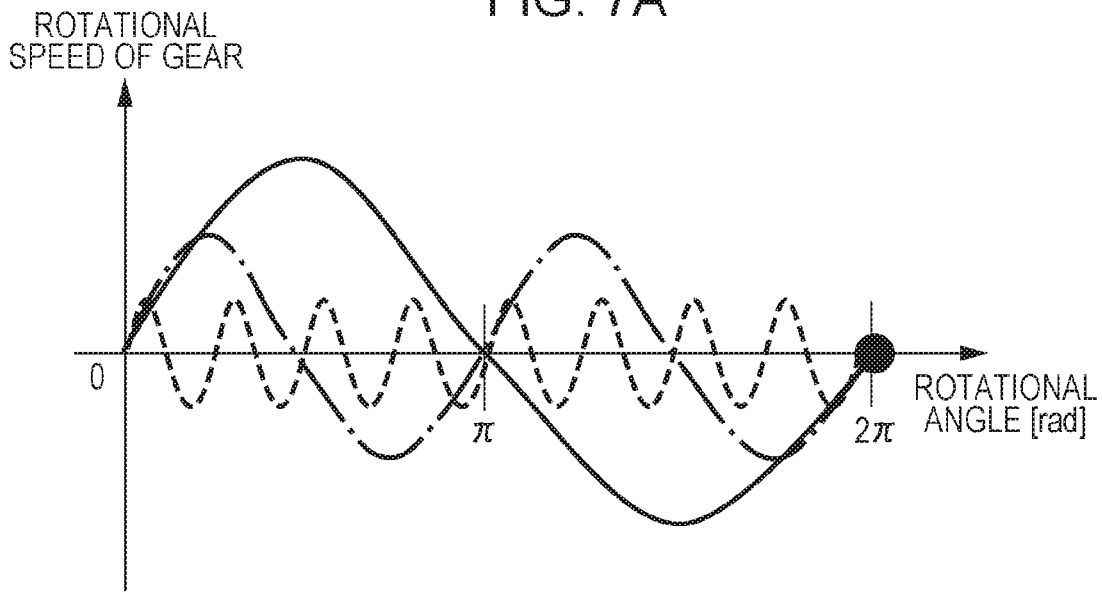
FIG. 7A is a conceptual diagram of rotational speeds of a part of gears of the photosensitive drum drive train of Embodiment 1 and FIG. 7B is a conceptual diagram of a rotational speed of a drum driving gear.
Figure 7B:
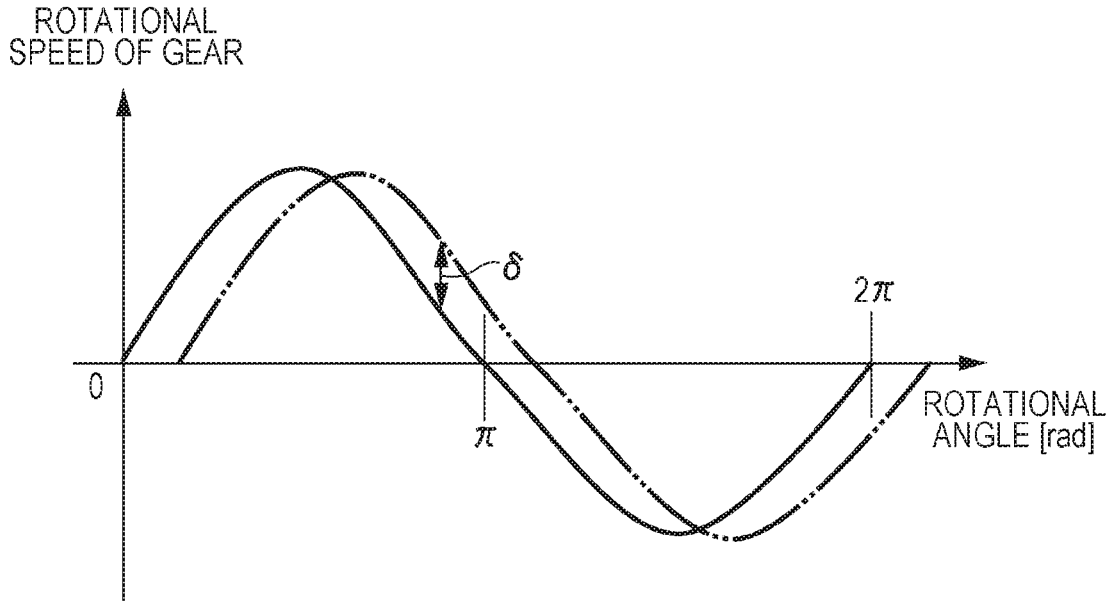
Figure 8:
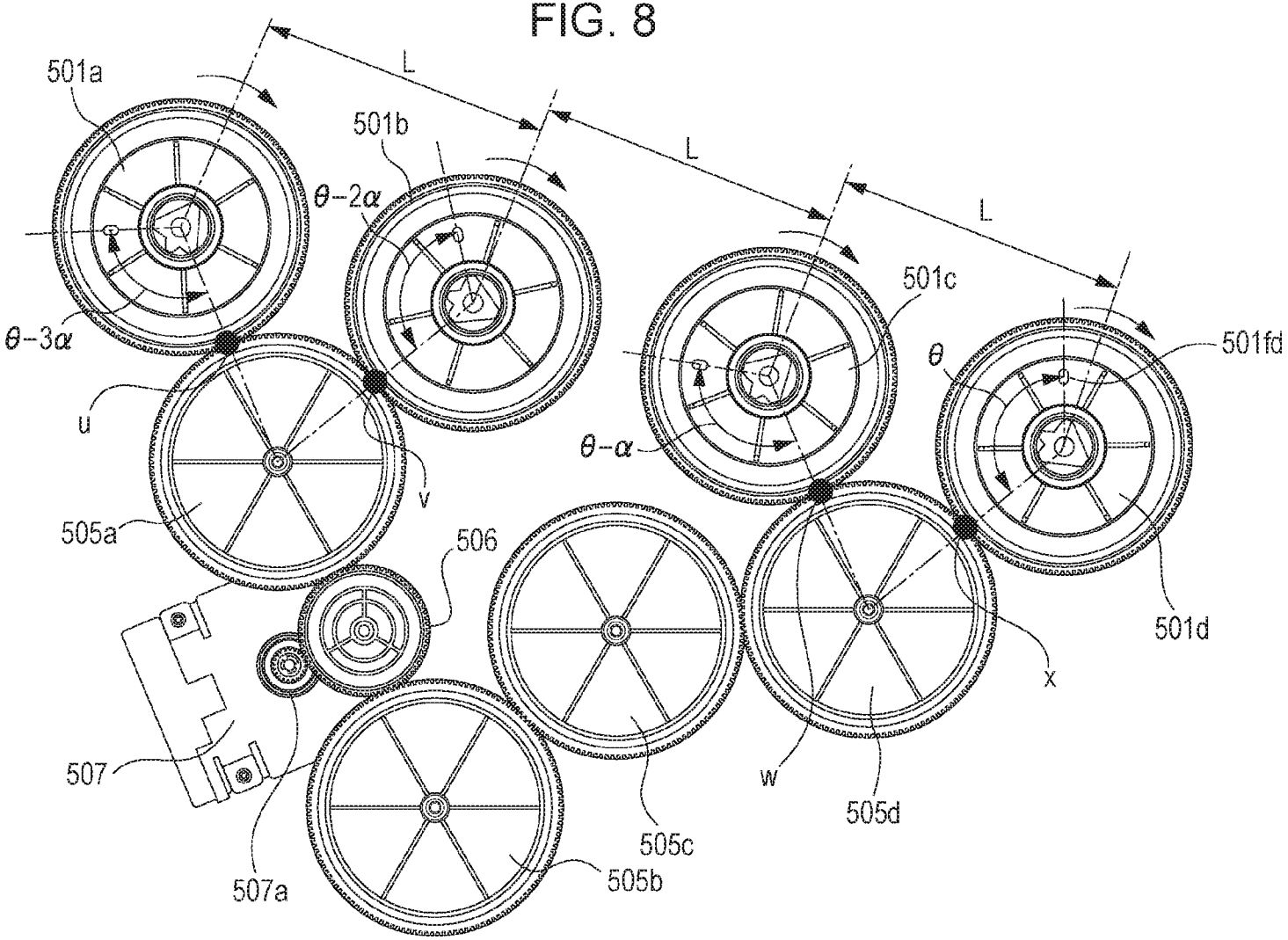
FIG. 8 is a plan view of the photosensitive drum drive train of Embodiment 1.

With reference to FIGS. 7A, 7B, and 8, decision of phases of gears of a photosensitive drum drive train will be described. FIG. 7A is a conceptual diagram of gear rotational speeds of the pinon gear 507*a* to an idler gear 505. FIG. 7B is a conceptual diagram of a gear rotational speed of the drum driving gear 501.

It is generally known that a rotational speed variation of a gear exhibits an almost sinusoidal wave. For example, a graph of a rotational speed variation of each of the gears from the pinion gear 507*a* to the idler gear 505*a*, in which a vertical axis indicates a rotational speed and a horizontal axis indicates a rotational angle of the gear, is illustrated in FIG. 7A. When the gears engaged with each other as described above have a natural number ratio relationship in the number of teeth, the pinion gear 507*a* makes eight rotations (broken line in FIG. 7A) and the stepped gear 506 makes two rotations (one-dot chain line in FIG. 7A) while the idler gear 505*a* makes one rotation (solid line in FIG. 7A). With such a gear ratio, while the idle gear 505*a* forms one sinusoidal wave in a cyclic period of one rotation, a synthetic speed of rotational speeds of the gears upstream of the idler gear 505*a* in the drive train also forms one sinusoidal wave in the same cyclic period. Note that, the gear ratio between the pinion gear 507*a* and the drum driving gear 501*c* or 501*d* is set so that the same effect is achieved, even though the idler gears 505*c* and 505*d* are also added in addition to the idler gear 505*b*.

A solid line part of FIG. 7B schematically illustrates a speed variation of the drum driving gear 501*d* during one rotation, similarly to FIG. 7A. For example, when a two-dot chain line part of FIG. 7B indicates a speed variation of the drum driving gear 501*a*, there is a peripheral speed difference between the photosensitive drums 1 of black (K) and yellow (Y). As a result, a positional shift corresponding to δ of the graph is caused between the colors of black (K) and yellow (Y) on an image. What is important to minimize a positional shift in a full-color image formed by magenta (M), cyan (C), and black (K) is as follows. That is, it is important to make profiles of the variations of the gear rotational speeds of the drum driving gears 501*a* to 501*d* uniform and to make the peripheral speeds of the drum driving gears 501 when the photosensitive drums 1 perform primary transfer onto the intermediate transfer belt 12*e* the same between the respective colors.

A relationship between the present embodiment and FIG. 7B will be described with reference to FIG. 8. FIG. 8 is a plan view of the photosensitive drum drive train of FIG. 6.

In each of the drum driving gears 501*a* to 501*d*, a gear portion that is formed of resin and has gear teeth and a flange portion that is formed of resin constituted by a material whose linear expansion coefficient is different from that of the gear portion are molded uniquely and integrally in a rotational direction with one mold. That is, in each of the driving gears, the flange portion is inserted in one mold and the gear portion is integrally molded therein. At the time of the molding, each of the driving gears is molded in a state where the one mold is set at the same position in the rotational direction of the gear. Thus, the profiles of the variations of the gear rotational speeds of the drum driving gears 501*a* to 501*d* become the same.

The drum driving gears 501 (501*a* to 501*d*) respectively have holes 501*f* (501*fa* to 501*fd*) as phase decision portions (rotational phase indication shapes) for deciding phases of rotational directions of the drum driving gears 501. Note that, though described later, each of the holes 501*fa* to 501*fd* as the phase decision portions is provided in corresponding one of flange portions each having a shaft portion of the drum driving gear integrally molded therein.

A distance L between stations in FIG. 8 is the same among stations of yellow (Y), magenta (M), cyan (C), and black (K), and is set to 96 mm in the present embodiment. A diameter D of the photosensitive drum 1 is 30 mm and the photosensitive drum 1 rotates by $D\times\pi\approx 94.2$ mm while the drum driving gear 501 makes one rotation.

Here, for explanation, the drum driving gear 501*d* corresponding to black (K) is engaged with the idler gear 505*d* on a driving upstream side thereof at a point x. An angle θ is an angle formed by a line connecting a center of the drum driving gear 501*d* and the hole 501*fd* for phase decision and a line connecting the center of the drum driving gear 501*d* and a center of the idler gear 505*d*. Similarly, an angle θ-α (hereinafter, referred to as an engagement phase angle) is an angle formed by a line connecting a center of the drum driving gear 501*c* and the hole 501*fc* for phase decision of the drum driving gear 501*c* and a line connecting a point w at which the drum driving gear 501*c* is engaged with the idler gear 505*d* and the center of the drum driving gear 501*c*. Similarly, an angle θ-2α is the engagement phase angle with respect to the dram driving gear 501*b* and an angle θ-3α is the engagement phase angle with respect to the drum driving gear 501*a*. By setting the angle α as 6.9[°]≈(96−94.2)[mm]/94.2 [mm]×360[°], the peripheral speeds of the drum driving gears 501 when the photosensitive drum 1 performs primary transfer onto the intermediate transfer belt 12*e* are able to be the same between the respective colors. When the driving portion 500 is assembled, a pin is arranged in an assembling jig (not illustrated) so as to form a desired engagement phase angle and is fitted into the hole 501*f* of each of the drum driving gears 501 as illustrated in FIG. 8, so that phase assembling of the drum driving gears 501 is enabled.

[About Configuration of Drum Driving Gear]

Figure 9A:
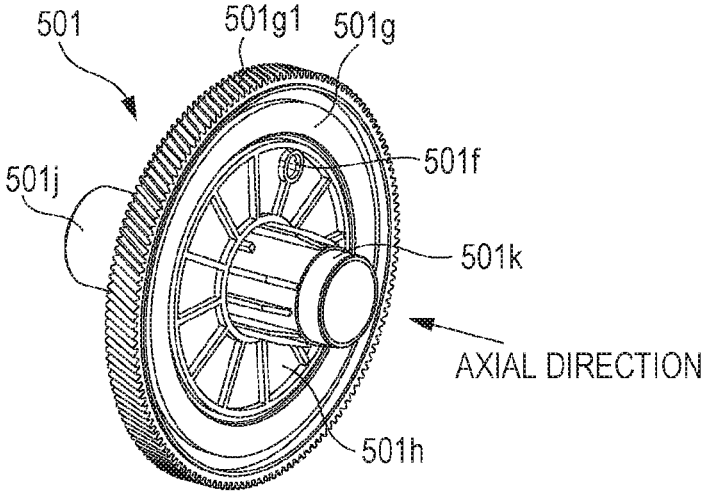
FIGS. 9A and 9B are perspective views of a drum driving gear of Embodiment 1 and FIG. 9C is a perspective view illustrating only a shaft portion of the drum driving gear.
Figure 9B:
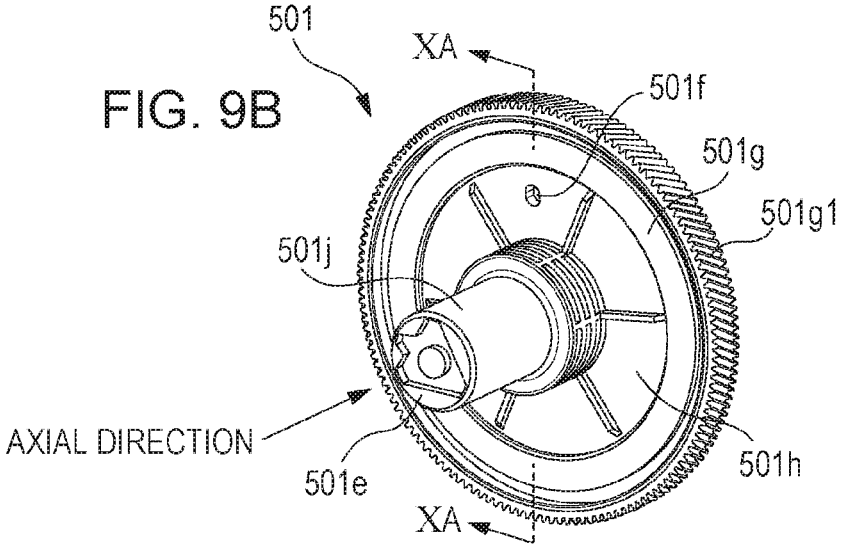
Figure 9C:
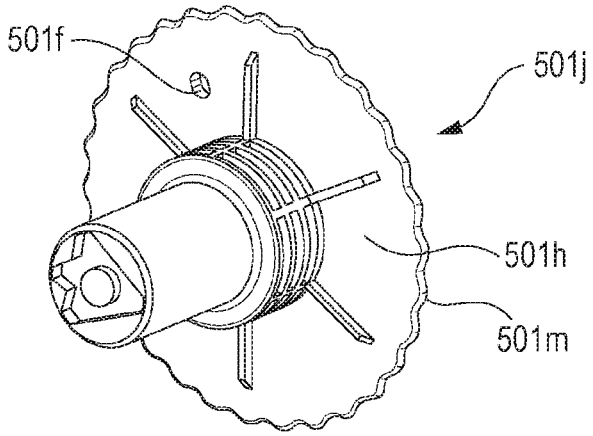

The drum driving gear 501 of the present embodiment will be described with reference to FIGS. 9A to 9C and 10A to 10C. FIGS. 9A and 9B are perspective views of the drum driving gear 501. FIG. 9C is a perspective view illustrating only a shaft portion 501*j*, in which a gear portion 501*g* is removed.

As illustrated in FIGS. 9A to 9C and 10A to 10C, the drum driving gear 501 as the drive transmitting member includes the gear portion 501*g* formed of resin and having gear teeth 501*g*1 and a flange portion 501*h* formed of resin. The flange portion 501*h* has the shaft portion 501*j* and a rotation stopper 501*m* integrally molded therein. Driving force from a motor is input to the gear portion 501*g*. The shaft portion 501*j* is engaged with the photosensitive drum 1 serving as the drive transmitted member to transmit the driving force input to the gear portion 501*g* to the photosensitive drum 1. The shaft portion 501*j* transmits, to the coupling 5*e* (refer to FIG. 3B) of the photosensitive drum 1 serving as the drive transmitted member, the driving force from the gear teeth 501*g*1. The rotation stopper 501*m* is a rotation stop portion that stops rotation of the gear portion 501*g* with respect to the flange portion 501*h* at an outer periphery of the flange portion and that is larger than an external form of the shaft portion 501*j*. The gear portion 501*g* has a shape that covers the rotation stopper 501*m* and is not overlapped with the shaft portion 501*j* as viewed in an axial direction of the shaft portion 501*j*.

The linear expansion coefficient of the resin forming the gear portion 501*g* of the drum driving gear 501 is larger than the linear expansion coefficient of the resin forming the flange portion 501*h* of the drum driving gear 501. Specifically, the linear expansion coefficient of the resin forming the gear portion 501*g* is $7.0\times10^{-5}$ (/° C.) or more. Flexural strength of the resin forming the gear portion 501*g* of the drum driving gear 501 is smaller than flexural strength of the resin forming the flange portion 501*h* of the drum driving gear 501. Specifically, the flexural strength of the resin forming the gear portion 501*g* is 100 MPa or less. As the resin forming the flange portion 501*h* of the drum driving gear 501, PPS (polyphenylene sulfide) resin is adopted to increase torsional rigidity for the purpose of accurately rotating the photosensitive drum 1. On the other hand, as the resin forming the gear portion 501*g* of the drum driving gear 501, POM (polyacetal) resin is used for the purpose of achieving an excellent sliding characteristic of a tooth surface. Since a variation of the peripheral speed of the drum driving gear 501 needs to be suppressed to be small, the drum driving gear 501 is integrally manufactured by insert molding for minimizing an axial displacement between the gear portion 501*g* and the shaft portion 501*j* integrally molded in the flange portion 501*h*. In the flange portion 501*h* in which the shaft portion 501*j* is integrally molded and which serves as a web surface of the drum driving gear 501, the rotation stopper 501*m* in a wave shape with respect to the gear portion 501*g* is formed.

Figure 22A:
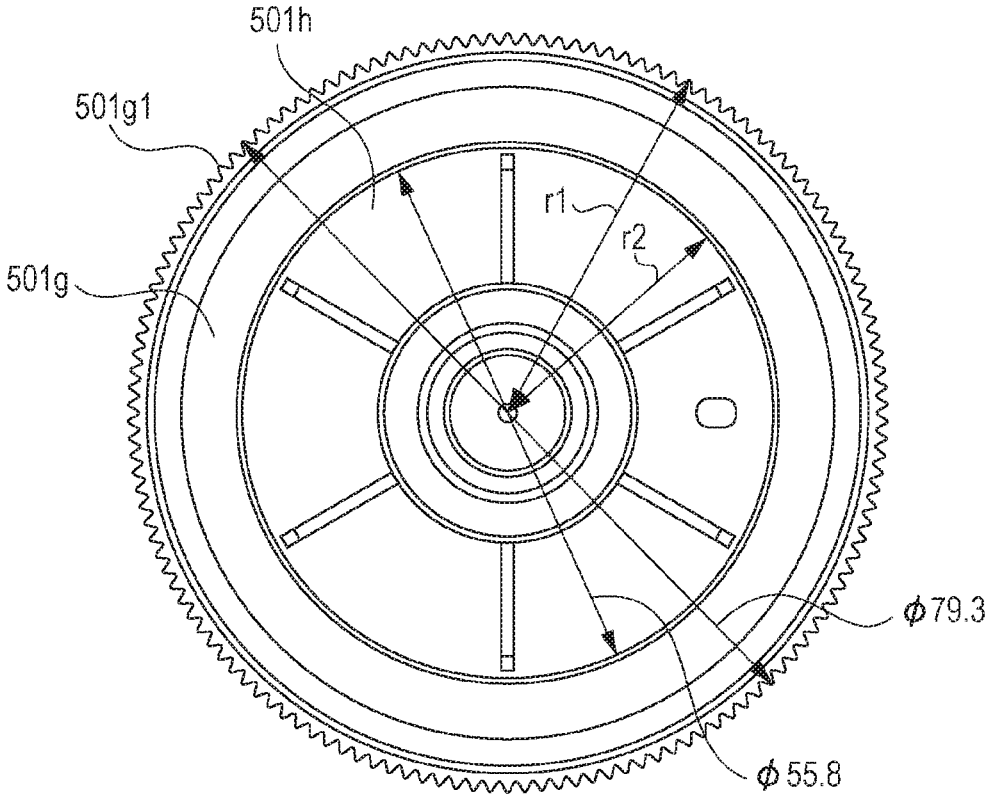
FIGS. 22A and 22B are plan views of the drum driving gear as viewed in the axial direction.

As described above, the gear portion 501*g* has the shape covering the rotation stopper 501*m*. Description will be given with reference to FIGS. 22A and 22B. FIG. 22A is a plan view of the drum driving gear 501 as viewed in the axial direction and FIG. 22B is a plan view of the flange portion 501*h* as viewed in the axial direction.

In FIG. 22A, a first radius r1 is a radius of a circle formed by an outer periphery of the gear portion 501*g*. A second radius r2 is a radius of a circle formed by an inner periphery of the gear portion 501*g*. As viewed in the axial direction, the first radius r1 of the gear portion 501*g* has a length in a range of 1.3 times to 1.5 times longer than the second radius r2 of the gear portion 501g. Here, a diameter of the outer periphery of the gear portion 501g is set to Φ79.3 and a diameter of the inner periphery of the gear portion 501g is set to Φ55.8, and the first radius r1 is set to be 1.42 times longer than the second radius r2.

Figure 22B:
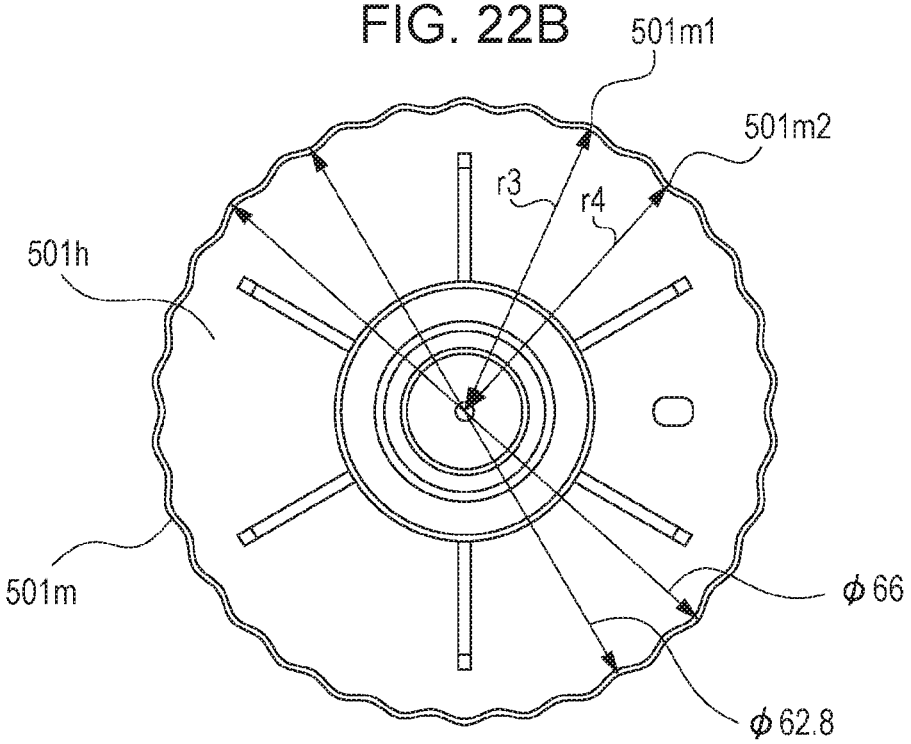

In FIG. 22B, a third radius r3 is a radius of a circle formed by rotation locus when a tip end of a convex portion 501m1 of the rotation stopper 501m rotates. A fourth radius r4 is a radius of a circle formed by rotation locus when a bottom side of a concave portion 501m2 of the rotation stopper 501m rotates. As illustrated in FIGS. 22A and 22B, as viewed in the axial direction, a length obtained by subtracting the second radius r2 of the gear portion 501g from the first radius r1 of the gear portion 501g is longer than a length obtained by subtracting the fourth radius r4 of the rotation stopper 501m from the third radius r3 of the rotation stopper 501m. Here, a diameter of the circle formed by the rotation locus of the tip end of the convex portion 501m1 of the rotation stopper 501m is set to Φ66.0, and a diameter of the circle formed by the rotation locus of the bottom side of the concave portion 501m2 of the rotation stopper 501m is set to Φ62.8.

As is apparent here, the third radius r3 that is a maximum radius and the fourth radius r4 that is a minimum radius in the circle related to the rotation stopper 501m are set to be shorter than the first radius r1 that is a maximum radius of the circle related to the gear portion 501g and longer than the second radius r2 that is a minimum radius of the circle related to the gear portion 501g. With such a design, the gear portion 501g has the shape covering the rotation stopper 501m.

Figure 10B:
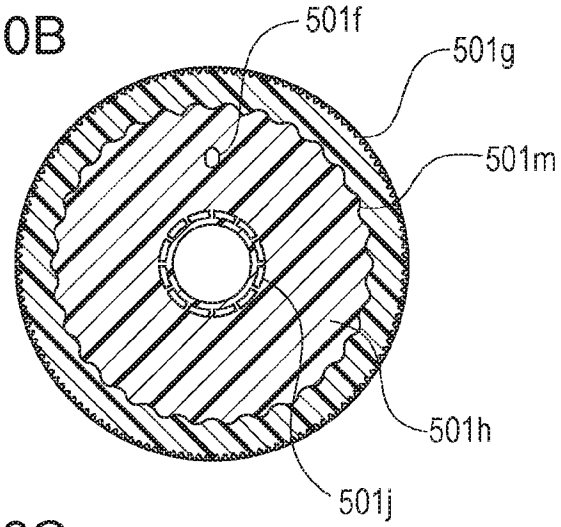
FIG. 10B is a sectional view of the drum driving gear taken along a line XB-XB in FIG. 10A.
Figure 10C:
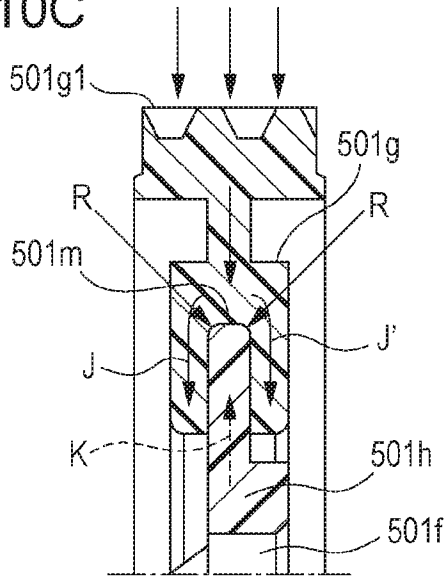
FIG. 10C is an enlarged view of a partial section of the drum driving gear of a part XC in FIG. 10A.
Figure 10A:
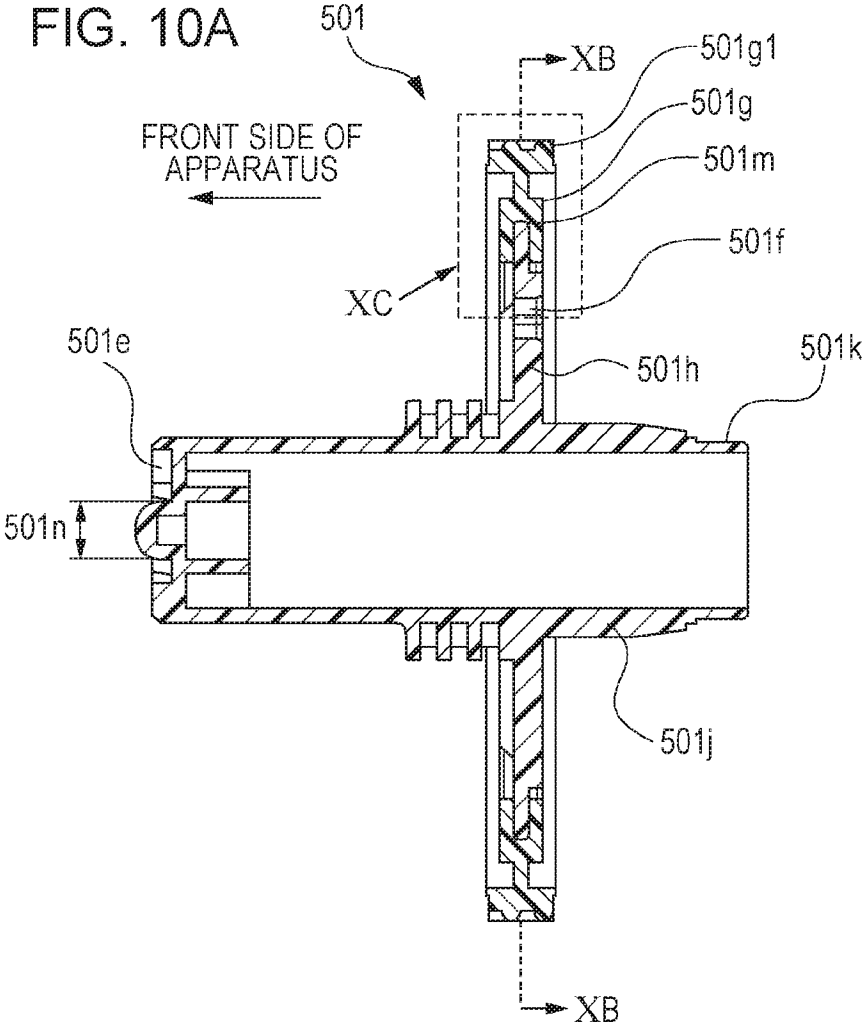
FIG. 10A is a sectional view of the drum driving gear of Embodiment 1 taken along a line XA-XA in a direction orthogonal to an axial direction in FIG. 9B.

FIG. 10A is a sectional view of the drum driving gear 501. FIG. 10B is a sectional view illustrating a section of a center of a gear tooth width in FIG. 10A. FIG. 10C is an enlarged view of a part XC surrounded by a broken line in FIG. 10A.

As illustrated in FIG. 10A, in the shaft portion 501j of the drum driving gear 501, a shaft end portion 501k on the back side of the apparatus is rotatably supported by a bearing (bearing member) (not illustrated) provided in a frame of the driving portion 500. In the shaft portion 501j, a boss portion 501n is at a center part of the coupling portion 501e opposite to the shaft end portion 501k and is rotatably supported so as to be fitted into a hole at a center part of the coupling 5e of FIG. 3B. A part of the shaft portion 501j, an outer diameter of which is smaller than that of the flange portion 501h and which is provided with the shaft end portion 501k or the boss portion 501n, serves as a supported portion. The shaft portion 501j is provided so as to be integrally molded in the flange portion 501h having the outer diameter larger than the outer diameter of the supported portion. In an outer peripheral part of the flange portion 501h, the rotation stopper 501m for the gear portion 501g is formed and an outer diameter thereof is larger than a minimum inner diameter of the gear portion 501g. For the purpose of reducing stress acting on the rotation stopper 501m resulting from a rotation load torque of the drum driving gear 501, the rotation stopper 501m is provided in the outer periphery of the flange portion 501h having an external form larger than an external form of the supported portion of the shaft portion 501j. Moreover, a plurality of rotation stoppers 501m are provided in such a manner that the same shape is repeatedly formed in the circumferential direction of the flange portion 501h. Here, as illustrated in FIG. 10B, thirty rotation stoppers 501m are formed so that a wave shape (roughness shape) with 12° in a rotational direction for one rotation stopper 501m is repeatedly formed. By integrally molding the gear portion 501g in the flange portion 501h having the shaft portion 501j and the rotation stoppers 501m integrally molded therein, the drum driving gear 501 is formed.

Further, in the section (FIG. 10C) taken along a direction orthogonal to an axial direction of the shaft portion 501j, the gear portion 501g is provided to be axially symmetric with the flange portion 501h as a center. Description will be given for suppression of deformation of the drum driving gear 501.

[About Suppression of Deformation of Drum Driving Gear]

As described above, the gear portion 501g is formed of the POM resin, and thus has a characteristic of shrinking (i) in a case where a temperature of resin melted during injection molding is reduced to a normal temperature and (ii) in a process where crystallization of POM resin that is crystalline resin advances. In particular, the linear expansion coefficient of the POM resin forming the gear portion 501g is about 10[×10-5/° C.] and the linear expansion coefficient of the PPS resin forming the flange portion 501h is about 5[×10-5/° C.]. In the case of (i) described above and (iii) in a case where the normal temperature is shifted to a low-temperature environment, the gear portion 501g shrinks so as to tighten the flange portion 501h to a shaft center side due to a difference between the linear expansion coefficients.

FIG. 10C schematically illustrates force acting on an inner part during the shrinkage. An arrow indicated with a solid line represents force acting when a POM resin part (gear portion) shrinks and an arrow K indicated with a broken line represents reaction force applied from a PPS resin part (flange portion) against the shrinkage of the POM resin. Shrinkage force from the gear portion 501g acts on a rim surface and then the web surface, and the shrinkage force bilaterally symmetrically branches to arrows J and J' with respect to the rotation stopper 501m. An R portion is provided in a ridgeline of the rotation stopper 501m to prevent a source of stress concentration from being generated in the inner part of the gear portion 501g while the shrinkage force branches. As described above, the plurality of rotation stoppers 501m are provided in such a form that the same shape (here, the roughness shape) is repeatedly formed in the circumferential direction of the flange portion 501h. Further, the hole 501f for phase decision is formed not in the gear portion 501g but on the flange portion 501h side. Thereby, the shrinkage force directed to a gear center is uniform at any phase in the circumferential direction. Such a form makes it possible to prevent the gear portion 501g from being inclined to the web surface or being deformed nonuniformly in the circumferential direction during the shrinkage.

As a result, it is possible to ensure high torsional rigidity and a sliding characteristic of a gear and suppress a deformation or slip during shrinkage in a gear obtained by insert molding with materials whose linear expansion coefficients are different, so that excellent image quality and endurance are able to be kept.

Embodiment 2

Next, Embodiment 2 will be described. Note that, an entire configuration of an image forming apparatus and a development contact-and-separation mechanism are similar to those of Embodiment 1, so that similar reference signs are assigned and description thereof is omitted. Embodiment 1 has a configuration in which the four photosensitive drums are driven by one motor for the process cartridge 7. On the other hand, in the present embodiment, the photosensitive drums 1a to 1c of yellow (Y), magenta (M), and cyan (C) are driven by one motor 507 and the photosensitive drum 1d of black (K) is driven by another motor 508. In addition, a photo-interruptor 54 and a photo-interruptor 55 as phase detecting units configured to detect a phase of a drum driving gear are used to perform phase matching of the drum driving gears 501*a* to 501*d*.

[Configuration of Driving of Photosensitive Drum]

A configuration of driving the process cartridge 7 in the present embodiment will be described with reference to FIGS. 11A, 11B, 12, and 13.

Figure 11A:
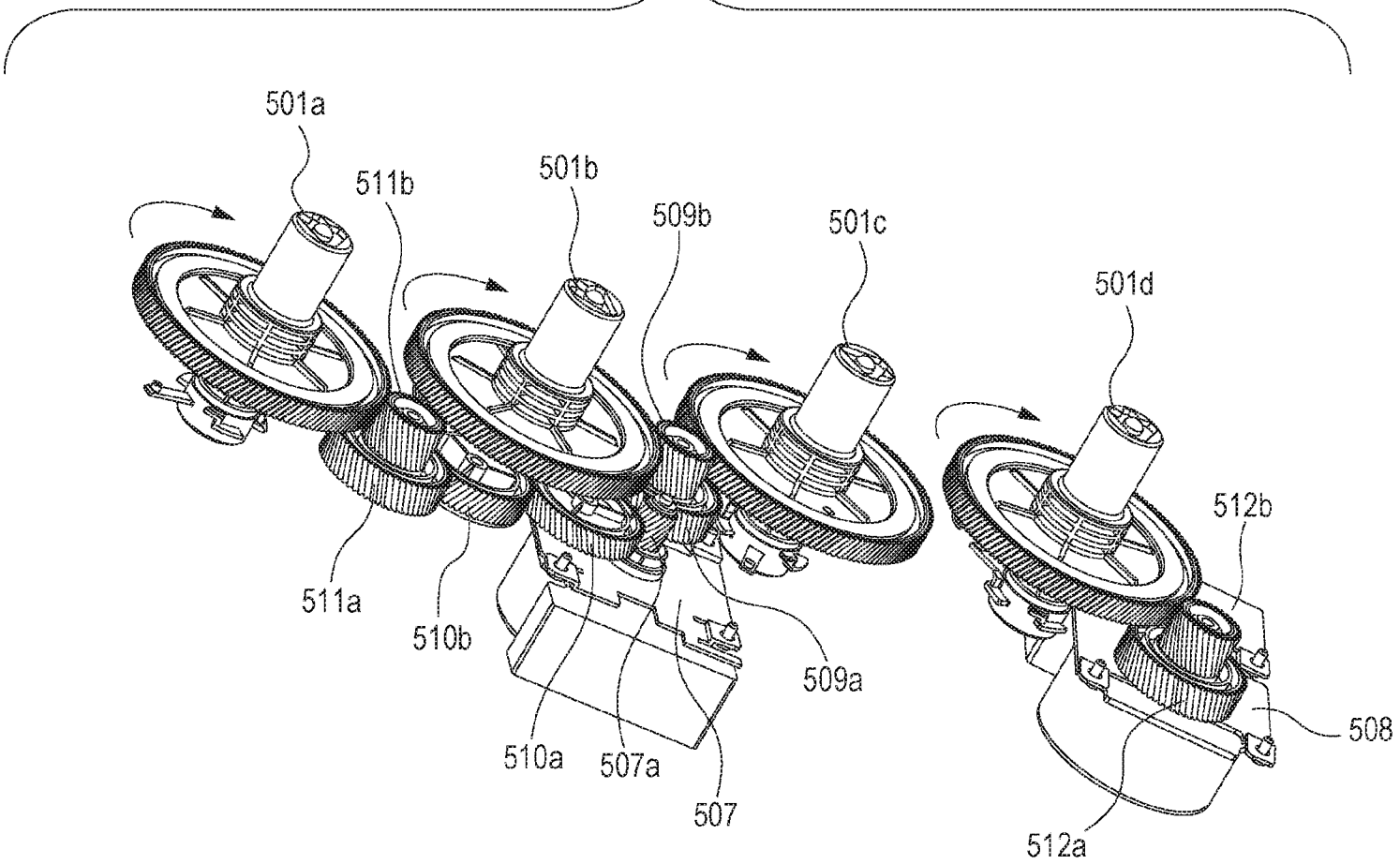
FIG. 11A is a perspective view of a photosensitive drum drive train of Embodiment 2 and FIG. 11B is a plan view of the photosensitive drum drive train.

FIG. 11A is a perspective view illustrating, similarly to FIG. 6, only a drive train from the motor 507 and the motor 508 serving as driving sources for driving the photosensitive drum 1 to the drum driving gears 501 (501*a* to 501*d*) on a drive output side. The motor 507 and the motor 508 respectively have the pinon gear 507*a* and a pinion gear 508*a* and are fixed to shafts of the respective motors. The pinon gear 507*a* is engaged with a large gear 509*a* of a stepped gear 509 and an idler gear 510*a*. The pinion gear 508*a* is engaged with a large gear 512*a* of a stepped gear 512. A small gear 509*b* of the stepped gear 509 is engaged with the drum driving gear 501*b* and the drum driving gear 501*c*. A small gear 512*b* of the stepped gear 512 is engaged with the drum driving gear 501*d*. The idler gear 510*a* is engaged with an idler gear 510*b* and the idler gear 510*b* is engaged with a large gear 511*a* of a stepped gear 511. A small gear 511*b* of the stepped gear 511 is engaged with the drum driving gear 501*a*.

Figure 11B:
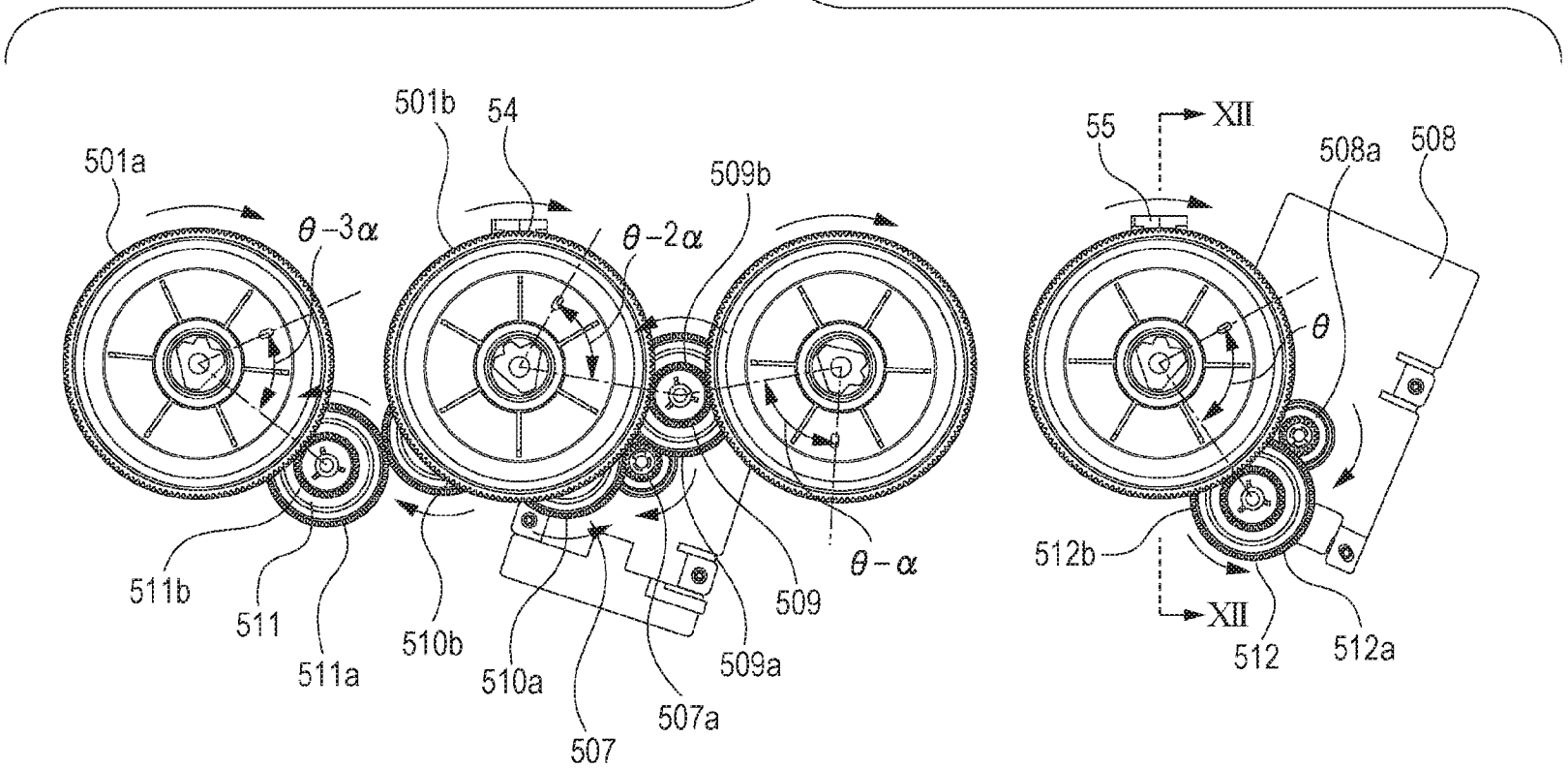

The drum driving gear 501*a* is driven from the pinion gear 507*a* via the idler gears 510*a* and 510*b* and the stepped gear 511. The drum driving gear 501*b* and the dram driving gear 501*c* are driven from the pinion gear 507*a* via the stepped gear 509. The drum driving gear 501*d* is driven from the pinion gear 508*a* via the stepped gear 512. In this manner, each of the driving gears rotates in a direction of an arrow indicated with a solid line in FIG. 11B by receiving driving force from the motor 507 or the motor 508. FIG. 11B is a plan view illustrating a photosensitive drum drive train similarly to FIG. 8. Phase assembling is performed so as to form the engagement phase angle described with FIGS. 7A and 7B and so that the drum driving gears 501*a* to 501*c* have a desired engagement phase angle by phase assembling of the drum driving gears 501 similarly to Embodiment 1. The engagement phase angle between a group of the drum driving gears 501*a* to 501*c* and the drum driving gear 501*d* is adjusted by performing drive control of the motor 507 and the motor 508 with use of the photo-interruptors 54 and 55. The photo-interruptors 54 and 55 are phase detecting units provided for the drum driving gear 501*b* and the drum driving gear 501*d*.

Figure 12:
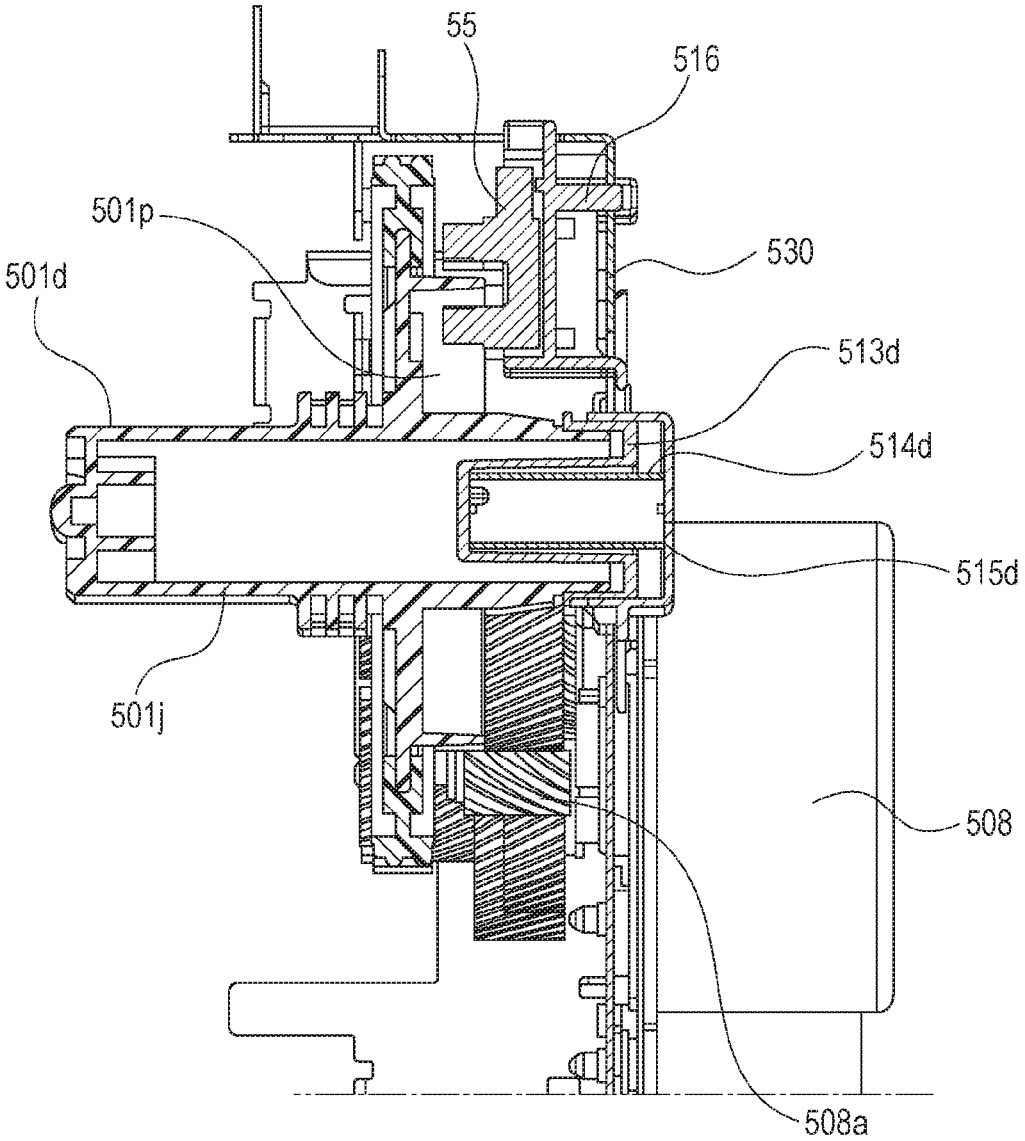
FIG. 12 is a partial sectional view of the photosensitive drum drive train of Embodiment 2 taken along a line XII-XII in a direction orthogonal to an axial direction in FIG. 11B.

FIG. 12 is a partial sectional view illustrating a configuration of a periphery of the drum driving gear 501*d* taken along a line XII-XII in FIG. 11B. As illustrated in FIG. 12, the drum driving gear 501*d* is provided with a flag portion 501*p* in a substantially cylindrical shape (detailed shape of which will be described later). The flag portion 501*p* shields or transmits light from the photo-interruptor 55 to thereby detect a phase of the drum driving gear 501*d* in a rotational direction. The photo-interruptor 55 is fixed to a drive frame 530 (added for explanation for FIGS. 11A and 11B) formed of a thin steel plate through a holder 516. The photo-interruptor 55 includes a light emitting portion that emits light and a light receiving portion that receives the light. The light emitted from the light emitting portion of the photo-interruptor 55 is shielded by the flag portion 501*p* or passes through a concave portion (described later) of the flag portion 501*p* and is received by the light receiving portion. Here, when the light emitted from the light emitting portion of the photo-interruptor 55 passes through the concave portion (described later) of the flag portion 501*p* and is received by the light receiving portion, the phase of the drum driving gear 510*d* as the drive transmitting member is decided. The drum driving gear 501*d* is rotatably supported by a bearing (bearing member) 515*d*. Between the drum driving gear 501*d* and the bearing 515*d*, a collar member 513*d* formed of resin softer than that of the shaft portion 501*j* is provided. The collar member 513*d* is press-fitted in a shaft end portion of the shaft portion 501*j* so as to integrally rotate with the shaft portion 501*j* of the drum driving gear 501*d*. By providing the collar member 513*d* between the bearing 515*d* and the shaft portion 501*j* in this manner, the bearing (bearing member) 515*d* is prevented from undergoing abrasion by the shaft portion 501*j*, which is formed of the PPS resin that is hard, through rotation of the drum driving gear 501*d*. The drum driving gear 501*d* is rotatably supported so as to be urged by an urging member 514*d* (compression spring) toward the front side of the apparatus from the bearing 515*d* fixed to the drive frame 530. Note that, a configuration of the rotatable support is similar also in the drum driving gears 501*a* to 501*c* and the photo-interruptor 54 is arranged in a similar manner to the photo-interruptor 55 described above.

Figure 13:
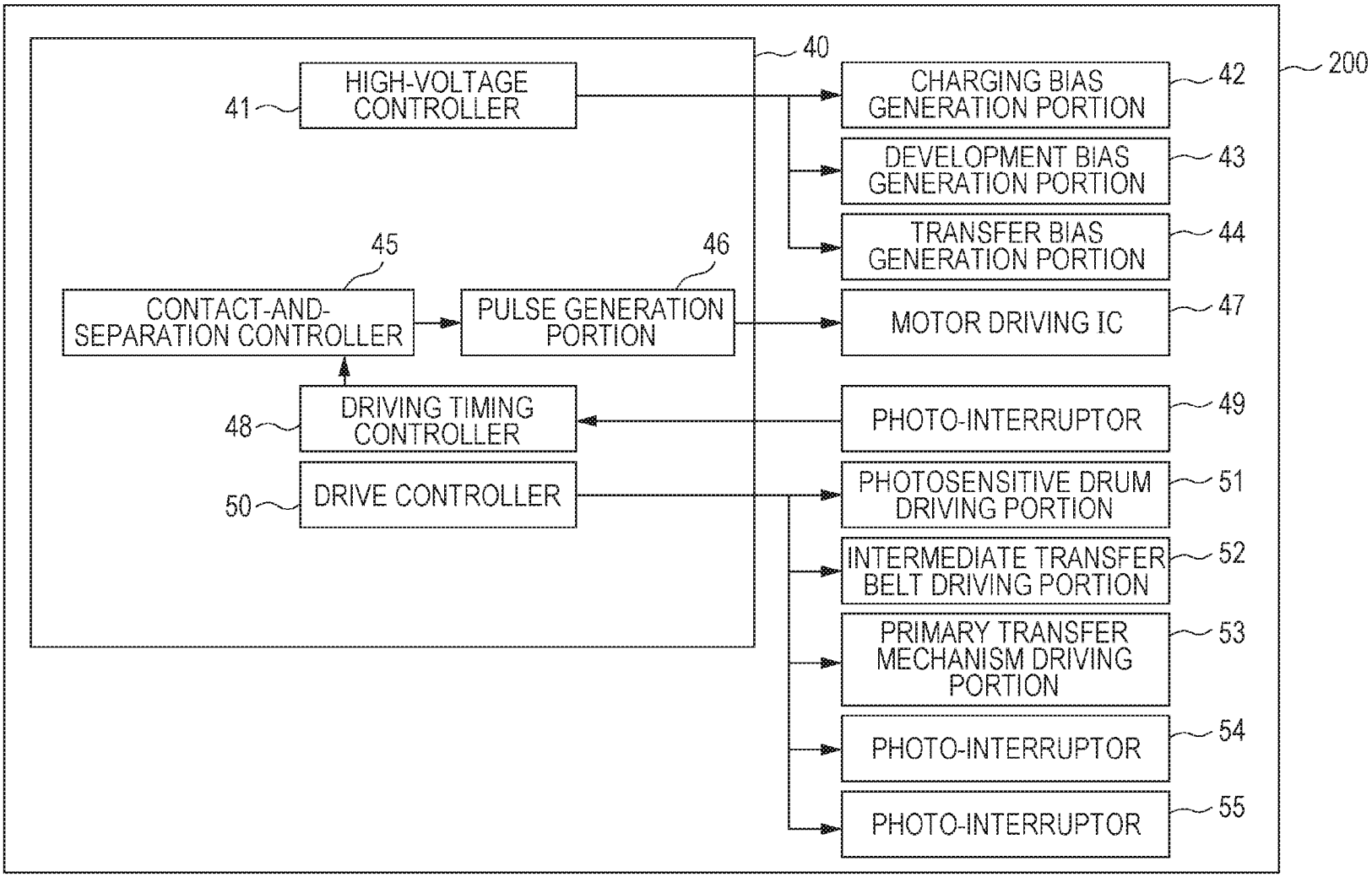
FIG. 13 is a block diagram illustrating a configuration of a controller of an image forming apparatus of Embodiment 2.

FIG. 13 is a block diagram illustrating a configuration of the controller 200 of the image forming apparatus, which is obtained by adding the photo-interruptor 54 and the photo-interrupter 55 to FIG. 4. Signals of the photo-interruptor 54 and the photo-interruptor 55 that are phase detecting units (position detecting sensors) are transmitted to the drive controller 50 and used so that a desired engagement phase angle is formed between the drum driving gears 501*a* to 501*c* and the drum driving gear 501*d*. Other configurations are similar to those of FIG. 4, so that description thereof is omitted here.

[Configuration of Drum Driving Gear]

A configuration of the drum driving gear 501 of the present embodiment will be described with reference to FIG. 14A to FIG. 18.

Figure 14A:
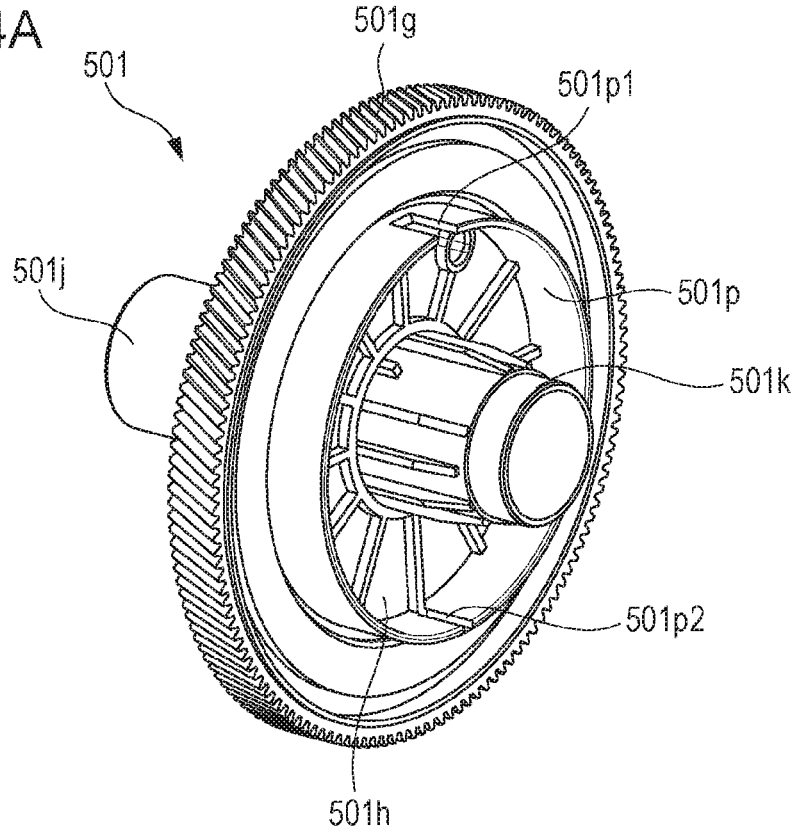
FIGS. 14A and 14B are perspective views of a drum driving gear of Embodiment 2.
Figure 14B:
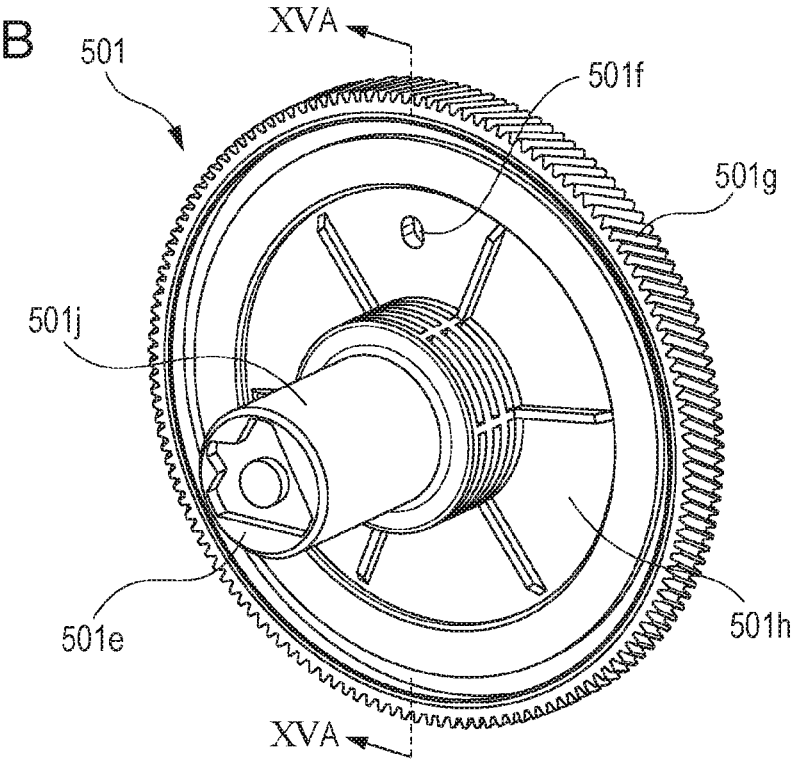

FIGS. 14A and 14B are perspective views of the drum driving gear 501 in the present embodiment. The drum driving gear 501 of the present embodiment is provided with the flag portion 501*p* as a phase decision portion (rotational phase indication shape) for deciding a phase of the drum driving gear in the rotational direction, in addition to the configuration of the drum driving gear illustrated in FIGS. 9A to 9C. The flag portion 501*p* is provided in the flange portion 501*h* including the shaft portion 501*j* and has two slit portions 501*p*1 and 501*p*2 as concave portions for detecting a phase of the drum driving gear 501 in the rotational direction. The slit portions 501*p*1 and 501*p*2 and the flag portion 501*p* are uniquely provided in the gear portion 501*g* (in a gear rotational direction) of the drum driving gear 501, so that the rotational phase of the gear is able to be detected by shielding or transmitting light from the photo-interruptors 54 and 55.

Outputs of the photo-interruptors 54 and 55 are connected to the drive controller 50 in the controller 200 that collectively controls an operation of the image forming apparatus (printer 100) as described above. Thereby, during rotation of the drum driving gears 501*c* and 501*d*, the controller 200 is able to recognize, through the photo-interruptors 54 and 55, timings of passing of the slit portions 501*p*1 and 501*p*2 provided in each of the drum driving gears 501*c* and 501*d*. The controller 200 is able to know a phase difference between both the drum driving gears 501*c* and 501*d* on the basis of such timings.

Then, the controller 200 executes, through the drive controller 50 and the photosensitive drum driving portion 51, electrical feedback control of the motor 507 and the motor 508 so as to obtain a desired phase difference between the drum driving gears 501*c* and 501*d*. In the present embodiment, the controller 200 checks such a phase difference, for example, in an initializing operation of the apparatus, and executes the feedback control of the motor 507 and the motor 508.

In this manner, in the present embodiment, the controller 200 has a function as a controlling unit for phase matching between the drum driving gears 501*c* and 501*d*. It is thus possible to form a phase difference of a predetermined angle α between a plurality of drum driving gears, even in a drum drive train where the drive train is not directly connected and phase assembling is not able to be performed.

Figure 15A:
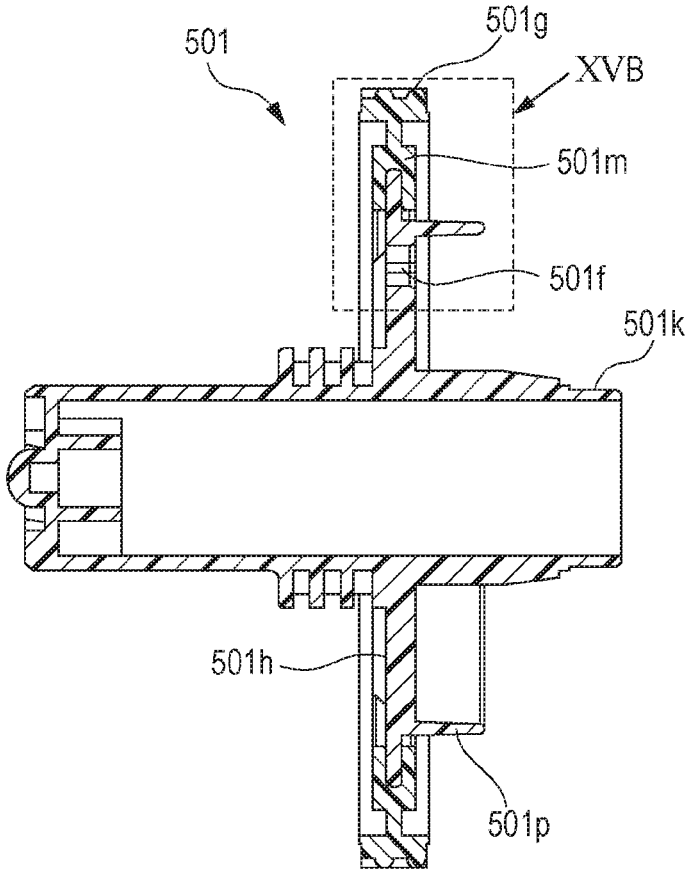
FIG. 15A is a sectional view of the drum driving gear of Embodiment 2 taken along a line XVA-XVA in a direction orthogonal to the axial direction in FIG. 14B
Figure 15B:
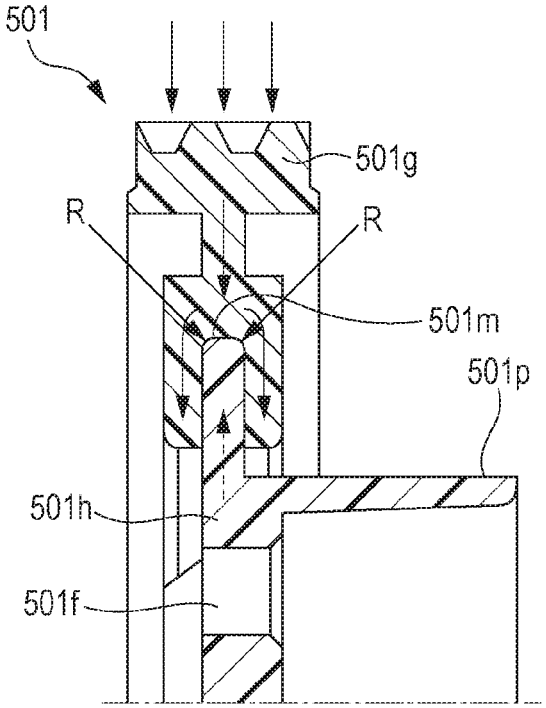
FIG. 15B is an enlarged view of a partial section of the drum driving gear of a part XVB in FIG. 15A.

FIGS. 15A and 15B are explanatory views illustrating the drum driving gear according to the present embodiment. FIG. 15A is a sectional view of the drum driving gear 501 taken along a line XVA-XVA in FIG. 14B. FIG. 15B is an enlarged view of a part XVB surrounded by a broken line in FIG. 15A and schematically illustrates force acting on an inner part during shrinkage of the gear portion 501*g*, similarly to FIG. 10C. As illustrated in FIGS. 15A and 15B, in the present embodiment as well, similarly to the embodiment described above, in the section taken along the direction orthogonal to the axial direction of the shaft portion 501*j*, the gear portion 501*g* includes the shaft portion 501*j* to be axially symmetric with the flange portion 501*h* as a center. That is, the flag portion 501*p* is formed in the flange portion 501*h* of the drum driving gear 501 and such a configuration does not affect symmetry of the gear portion 501*g*. Thus, similarly to Embodiment 1, even when the gear portion 501*g* shrinks, it is possible to prevent the gear portion 501*g* from being inclined to the shaft portion 501*j* or the flange portion 501*h* which is the web surface or being deformed nonuniformly in the circumferential direction. When the flag portion 501*p* is formed in the flange portion 501*h*, not the POM resin having a black color but a material having a natural color is able to be adopted for the gear portion 501*g*. As a result, it is possible to suppress an amount of a pigment or additive in the material and keep mechanical properties of the gear portion 501*g* high.

Figure 16A:
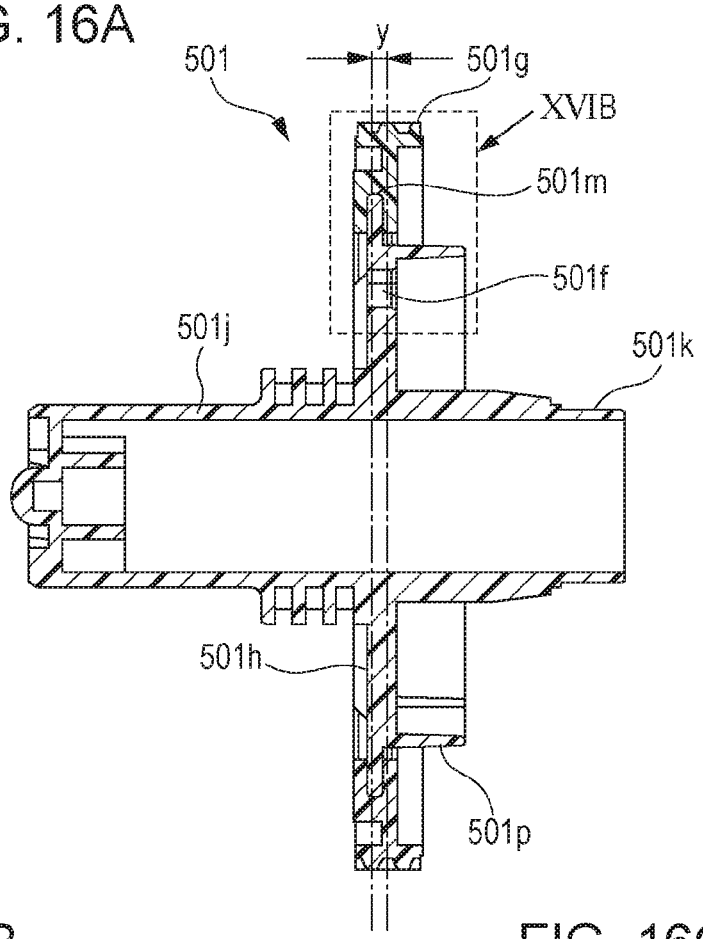
FIG. 16A is a sectional view of the drum driving gear of Embodiment 2 taken along the direction orthogonal to the axial direction.
Figure 16B:
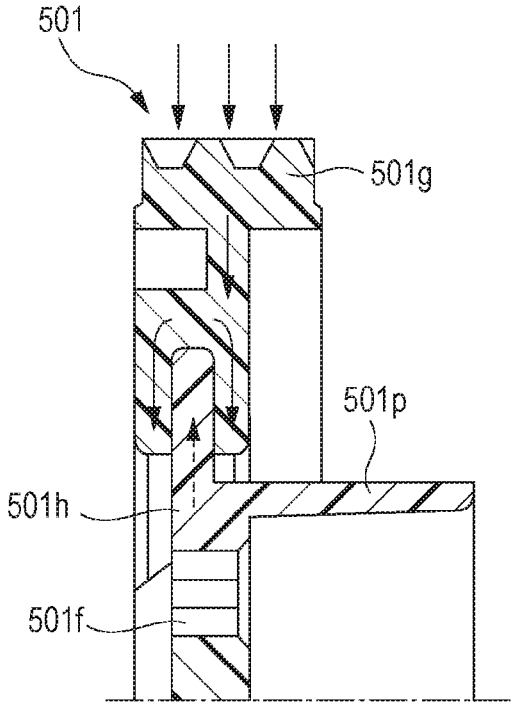
FIG. 16B is an enlarged view of a partial section of the drum driving gear of a part XVIB in FIG. 16A.
Figure 16C:
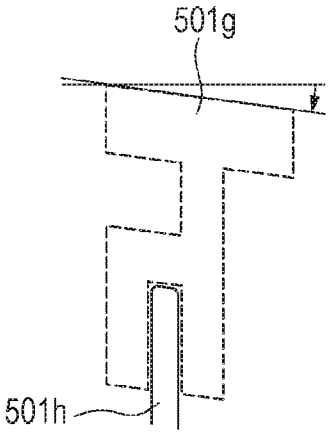
FIG. 16C is a conceptual diagram related to deformation of a gear portion of the drum driving gear.

FIGS. 16A to 16C are explanatory views illustrating a drum driving gear according to a comparative example 1. FIGS. 16A to 16C illustrate a configuration in a case where web surfaces of the flange portion (flange surface) 501*h* and the gear portion 501*g* are shifted in the axial direction by y, compared to FIGS. 15A and 15B. That is, in the drum driving gear according to the comparative example 1, the gear portion 501*g* is axially asymmetric with the flange portion 501*h*, which includes the shaft portion 501*j*, as a center in the section taken along the direction orthogonal to the axial direction of the shaft portion 501*j*. Note that, FIGS. 16A and 16B are views that respectively correspond to FIGS. 15A and 15B. As illustrated in FIG. 16B, when shrinking so as to tighten the flange portion 501*h* to a shaft center side as indicated with an arrow of a solid line in FIG. 16B, the gear portion 501*g* receives reaction force as indicated with an arrow of a broken line from the flange portion 501*h* due to a difference between linear expansion coefficients. At this time, due to the shift y in the axial direction, the flange portion 501*h* is not able to support the center of the gear portion 501*g*. Thus, the gear portion 501*g* is deformed so as to fall to a side where the gear portion 501*g* is less likely to receive the reaction force (broken line in FIG. 16B) from the flange portion 501*h* as illustrated in FIG. 16C.

Figure 17C:
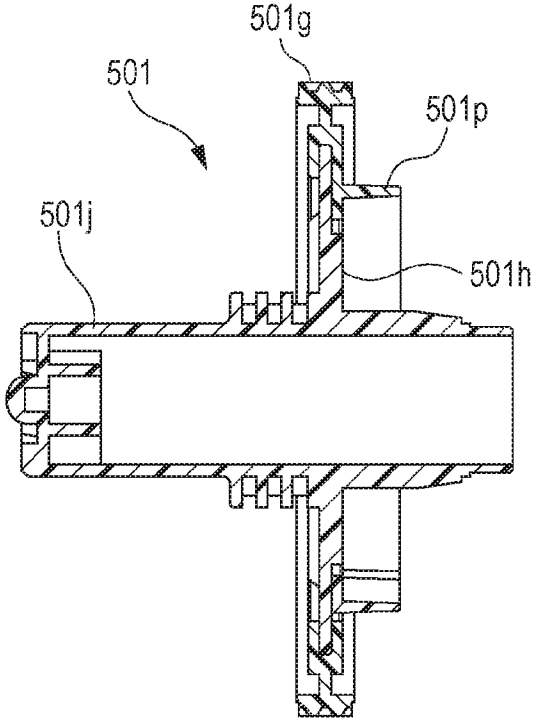
FIGS. 17A and 17B are perspective views of the drum driving gear of Embodiment 2 and FIG. 17C is a sectional view of the drum driving gear taken along a line XVIIC-XVIIC in a direction orthogonal to the axial direction in FIG. 17B.
Figure 17B:
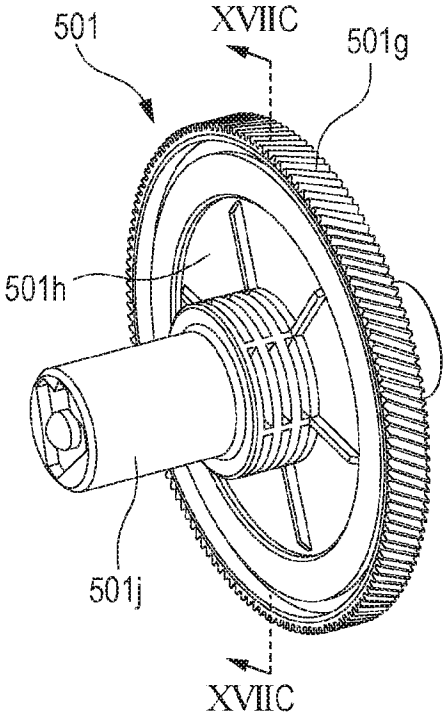
Figure 17A:
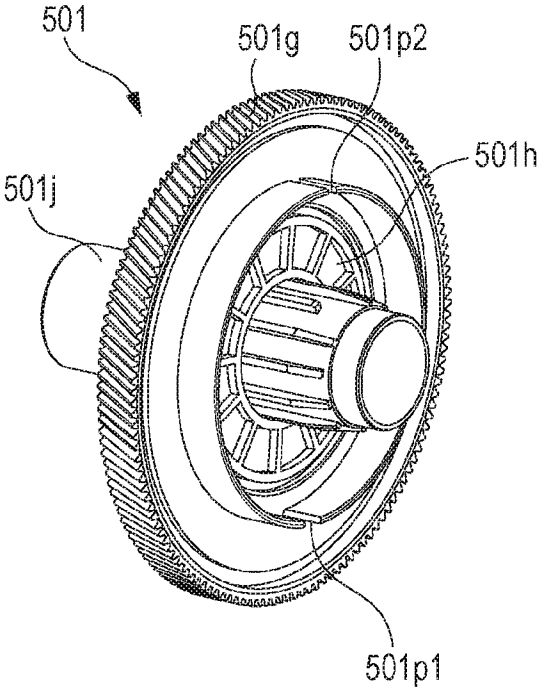

FIGS. 17A to 17C are explanatory views illustrating a drum driving gear according to a comparative example 2. While the drum driving gear according to the present embodiment has the flag portion formed on the shaft portion side, the drum driving gear according to the comparative example 2 has the flag portion on the gear portion side. That is, FIGS. 17A and 17B are perspective views of the drum driving gear 501 in which the flag portion 501*p* is formed on the gear portion 501*g* side, compared to the configuration in which the flag portion 501*p* is formed on the shaft portion 501*j* side as illustrated in FIGS. 15A and 15B. FIG. 17C is a sectional view of the drum driving gear 501 taken along a line XVIIC-XVIIC in FIG. 17B. Note that, in such a configuration, the flag portion 501*p* needs to shield infrared light from the photo-interruptor 54 or the photo-interruptor 55 and is thus formed of a black material.

Figure 18:
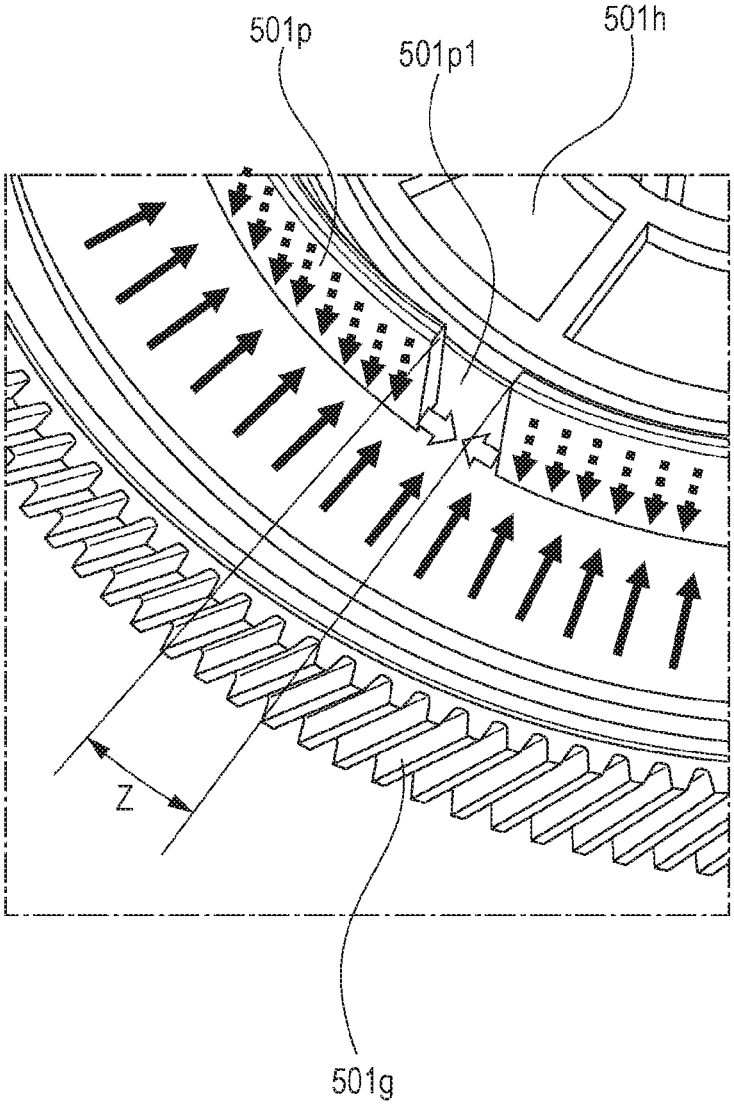
FIG. 18 is an enlarged perspective view conceptually illustrating shrinkage force acting on an inner part of the drum driving gear in the image forming apparatus of Embodiment 2.

FIG. 18 is an enlarged view (perspective view) of a part of the slit portion 501*p*1 illustrated in FIG. 17A and schematically illustrates force acting on the inner part during shrinkage of the gear portion 501*g*, similarly to FIG. 10C. The gear portion 501*g* shrinks in an axial direction as indicated with an arrow of a solid line. The flag portion 501*p* shrinks so that a height of a rib is reduced in a direction indicated with an arrow of a broken line and further shrinks so that a radius of the flag portion 501*p* is reduced as indicated with a white-filled arrow in the slit portion 501*p*1. Here, in a section z of the slit portion 501*p*1, resistance inside the gear portion 501*g* is different from that in a part of the flag portion 501*p*, in which the rib exists, so that the section z is a region where stress at the time of the shrinkage is ununiform. In other words, since the region (section z of the slit portion 501*p*1) is a source of stress concentration, deformation of the gear portion 501*g* at a part corresponding to the section z is caused and gear accuracy may be affected.

Thus, compared to the configuration in which the flag portion 501*p* is formed on the gear portion 501*g* side as illustrated in FIGS. 17A to 17C and 18, the configuration in which the flag portion 501*p* is formed in the flange portion 501*h* on the shaft portion 501*j* side as illustrated in FIGS. 14A, 14B, 15A, and 15B makes it possible to suppress the deformation during molding of the gear.

[About Collar Member of Drum Driving Gear]

Figure 19C:
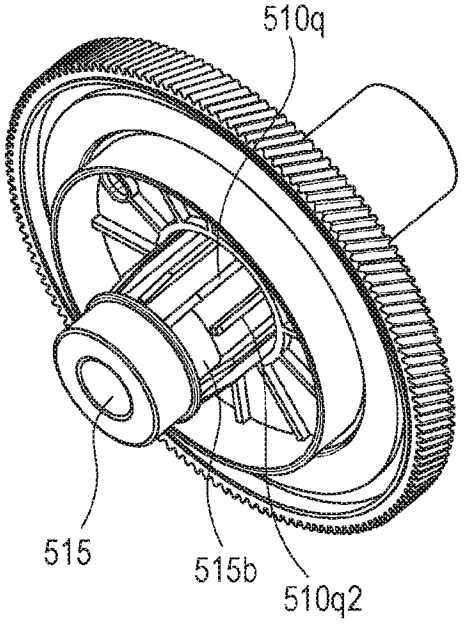
FIGS. 19A to 19C are perspective views of the drum driving gear with a collar member of Embodiment 2.
Figure 19B:
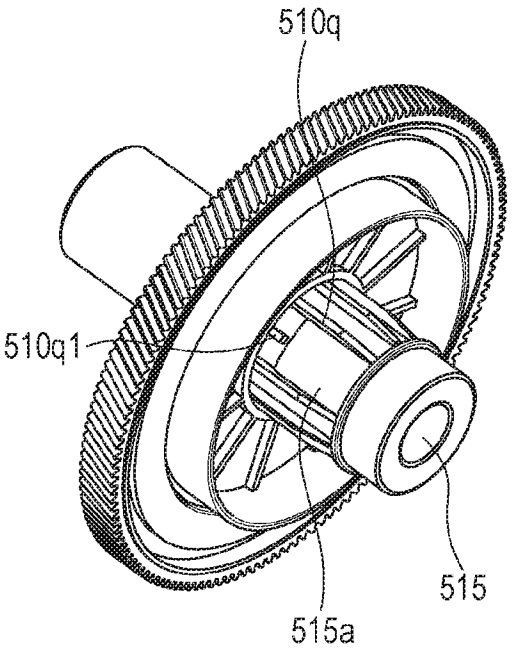
Figure 19A:
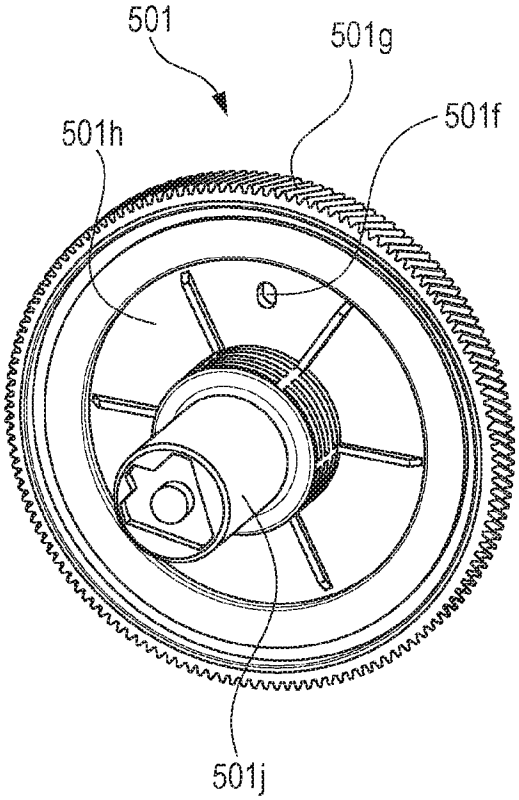

With reference to FIGS. 19A to 19C, the collar member 513 illustrated in FIG. 12 will be described. FIG. 19A is a perspective view of the drum driving gear 501 on the coupling side and FIGS. 19B and 19C are perspective views in which a collar member 515 is attached to a shaft end portion (supported portion) in the shaft portion 501*j* of the drum driving gear 501. In the collar member 515, a plurality of (here, two) ribs (projections) 515*a* and 515*b* whose lengths in the axial direction are different are formed in the circumferential direction. Here, one rib 515*a* is formed to have a longer length in the axial direction than that of the other rib 515*b*. In the shaft portion 501*j* to which the collar member 515 is attached, attachment portions 510*q*1 and 510*q*2 respectively according to the lengths of the ribs 515*a* and 515*b* in the axial direction are provided at positions corresponding to the ribs 515*a* and 515*b* in the circumferential direction. Here, the attachment portions 510*q*1 and 510*q*2 are formed by multiple radial ribs 510*q* that are formed in a radial manner in the axial direction. Thereby, the gear portion 501*g* and the shaft portion 510*j* are uniquely molded in the rotational direction, and further, the collar member 515 is also uniquely attached in the rotational direction.

Actually, there is also an axial displacement between an inner diameter of the collar member and an outer diameter of the shaft portion. Thus, for example, when the collar member 515 is molded by the same mold, the drum driving gear 501 with the collar member 515 is uniquely assembled. Thereby, similarly to FIG. 7B, it is possible to make profiles of variations of the gear rotational speeds of the drum driving gears 501*a* to 501*d* corresponding to yellow (Y), magenta (M), cyan (C), and black (K) uniform. It is also possible to make the peripheral speeds of the drum driving gears 501 when the photosensitive drum 1 performs primary transfer onto the intermediate transfer belt 12*e* the same between the respective colors.

[Other Embodiments]

In the embodiment described above, a tip end of a driven coupling on a process cartridge side has a convex shape and a tip end of a driving coupling of a drum driving gear on an apparatus main body side has a concave shape engaged with the convex shape, but there is no limitation thereto. A configuration may be such that the shapes of the driving coupling and the driven coupling may be replaced with each other so that the concave shape and the convex shape are reversed. That is, the tip end of the driving coupling of the drum driving gear on the apparatus main body side may have a convex shape and the tip end of the driven coupling on the process cartridge side may have a concave shape engaged with the convex shape.

FIGS. 20A to 20E illustrate, as a reference example, a modified example of the drum driving gear according to the comparative example 2 described with reference to FIGS. 17A to 17C. FIGS. 20A to 20E are explanatory views of the drum driving gear according to the reference example.

Figure 20A:
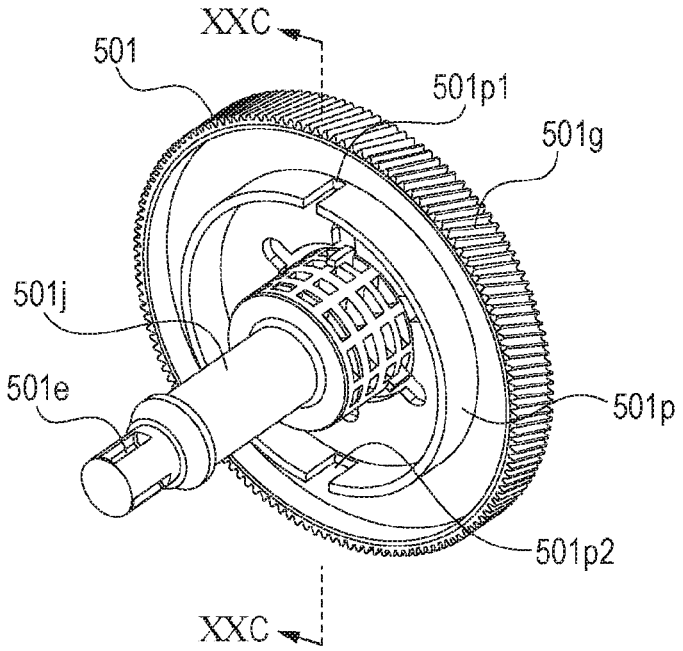
FIGS. 20A, 20B, and 20E are perspective views related to a modified example of the drum driving gear.
Figure 20B:
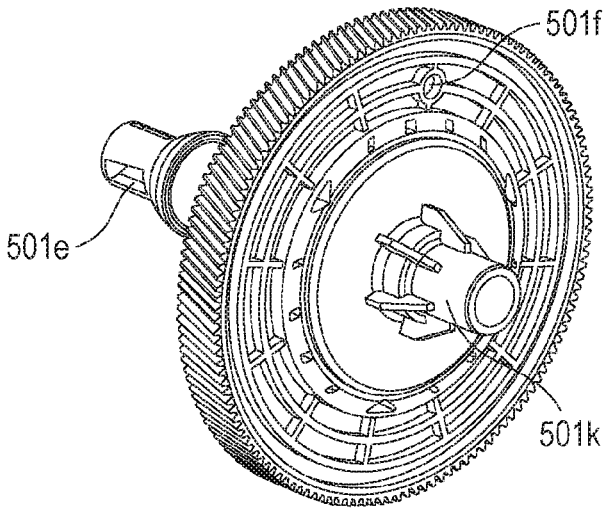
Figure 20C:
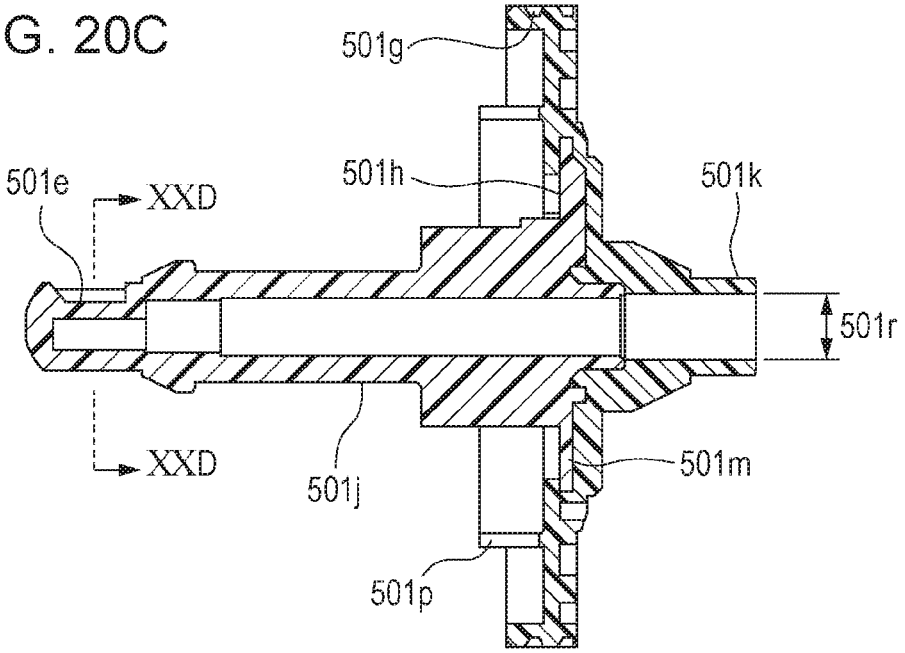
FIG. 20C is a sectional view taken along a line XXC-XXC in FIG. 20A.
Figure 20D:
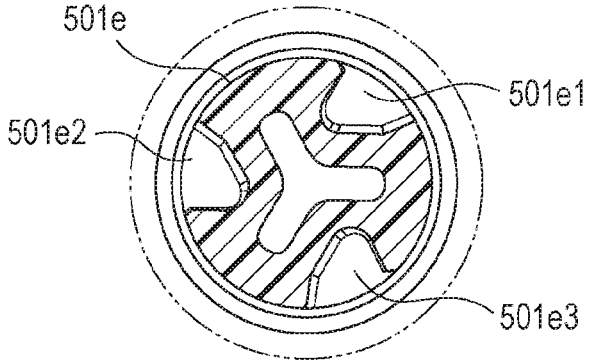
FIG. 20D is a partial sectional view taken along a line XXD-XXD in FIG. 20C.
Figure 20E:
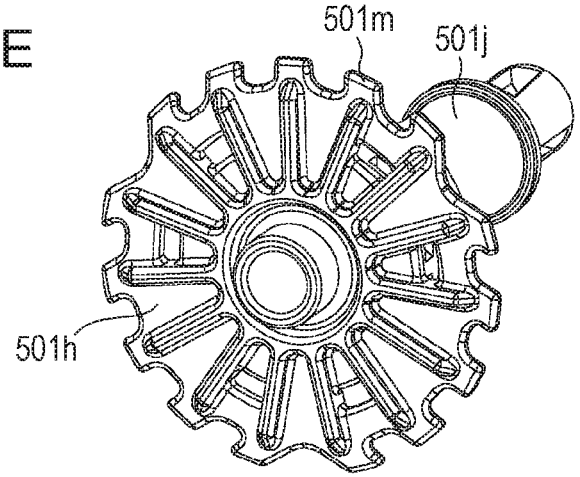

While the flag portion is formed on the shaft end portion side in the drum driving gear according to the comparative example 2 illustrated in FIGS. 17A to 17C, the flag portion is formed on the coupling portion side and the coupling portion is formed in a shape with a plurality of grooves in the drum driving gear according to the modified example. That is, FIGS. 20A and 20B are perspective views of the drum driving gear 501 in which the flag portion 501*p* is formed on the coupling portion 501*e* side, compared to the configuration in which the flag portion 501*p* is formed on the shaft end portion 501*k* side as illustrated in FIG. 17C. A sectional view of the drum driving gear 501 taken along a line XXC-XXC in FIG. 20A is illustrated in FIG. 20C. Further, a partial sectional view of the coupling portion 501*e* taken along a line XXD-XXD in FIG. 20C is illustrated in FIG. 20D. FIG. 20E is a perspective view illustrating only the shaft portion 501*j* of the drum driving gear 501. Groove portions 501*e*1 to 501*e*3 of the coupling portion 501*e* are arranged in the same shapes at an equidistant angle of 120° in a direction of an arrow indicated with a solid line in FIG. 20D. When the drum driving gear 501 rotates in the direction of the arrow indicated with the solid line in FIG. 20D, each of the groove portions 501*e*1 to 501*e*3 of the coupling portion 501*e* is engaged with a coupling (not illustrated) which has a convex shape to be engaged with each of the groove portions 501*e*1 to 501*e*3 and which is on the photosensitive drum 1 side, so that drive is transmitted. Also in such a configuration, the shaft portion 501*j* is provided so as to be integrally molded in the flange portion 501*h* that has an outer diameter larger than an outer diameter of a minimum inner diameter portion 501*r* of the gear portion 501*g* near the supported portion. In the flange portion 501*h*, the rotation stopper 501*m* the outer diameter of which is larger than the minimum inner diameter of the gear portion 501*g* is formed. By integrally molding the gear portion 501*g* in the flange portion 501*h* having the shaft portion 501*j* and the rotation stopper 501*m* integrally molded therein, the drum driving gear 501 is formed.

In the drum driving gear according to the comparative example 2 illustrated in FIGS. 17A to 17C, however, an area of the gear portion 501*g* formed of resin is large and the resin has multiple thin layers, so that residual stress due to shrinkage during molding is large. Thus, when strength of a material is additionally reduced as time has lapsed, a temporal change of the resin is caused so that the gear portion 501*g* may be deformed.

Subsequently, as another embodiment, a modified example of the drum driving gear according to Embodiment 2 described with reference to FIGS. 16A to 16C is illustrated in FIGS. 21A to 21E. FIGS. 21A to 21E are explanatory views of the drum driving gear according to another embodiment.

Figure 21A:
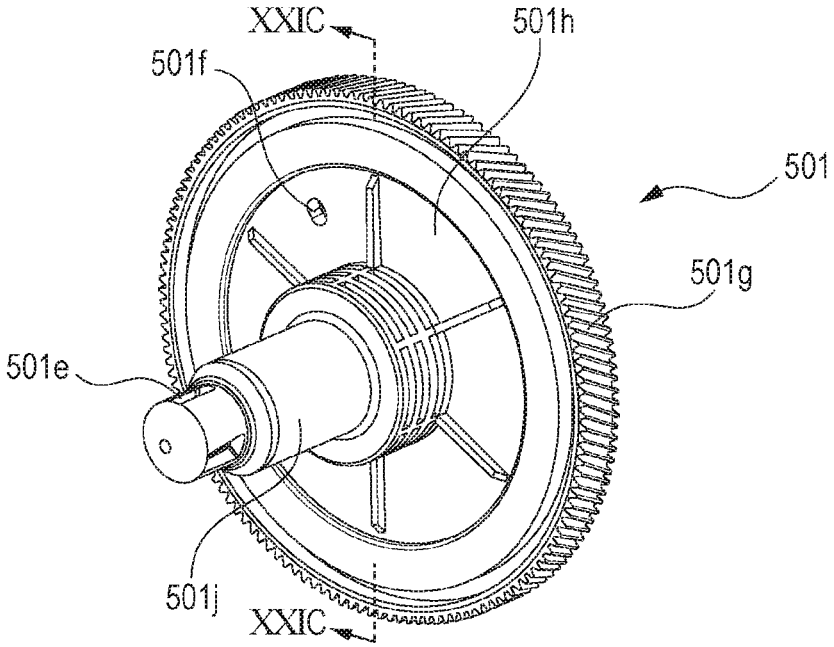
FIGS. 21A, 21B, and 21E are perspective views related to a modified example of the drum driving gear.
Figure 21B:
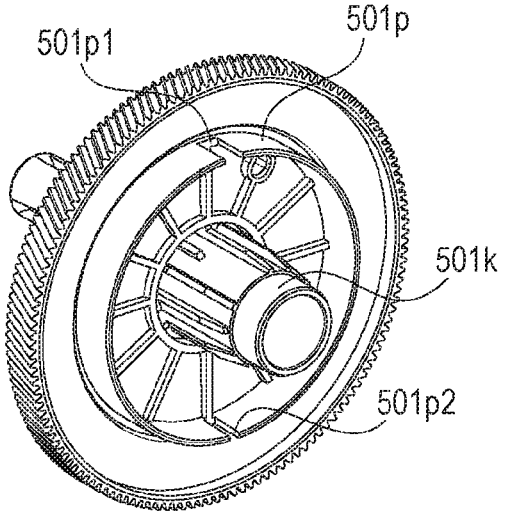
Figure 21C:
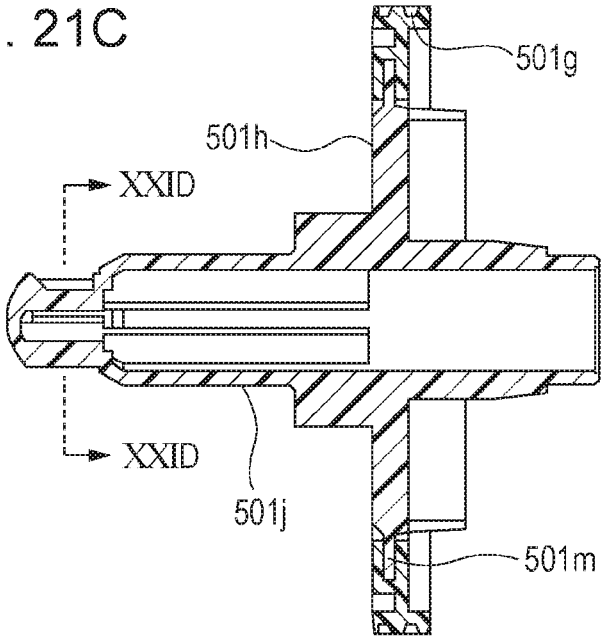
FIG. 21C is a sectional view taken along a line XXIC-XXIC in FIG. 21A.
Figure 21D:
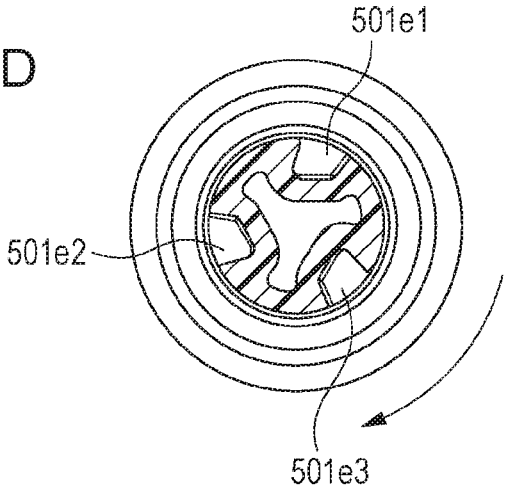
FIG. 21D is a partial sectional view taken along a line XXID-XXID in FIG. 21C.
Figure 21E:
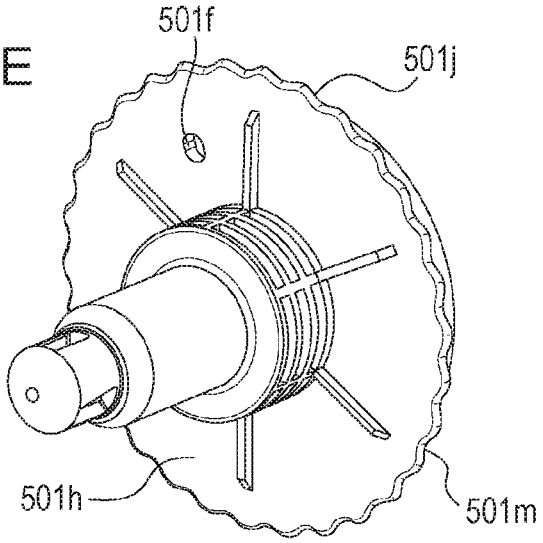

In the drum driving gear according to the present embodiment illustrated in FIGS. 21A to 21E, the coupling portion (FIG. 14B) in a substantially triangle shape is formed by a plurality of groove portions, similarly to the drum driving gear 501 illustrated in FIGS. 20A to 20E. That is, FIGS. 21A and 21B are perspective views of the drum driving gear 501 in which the coupling portion illustrated in FIGS. 16A to 16C is formed by a plurality of groove shapes in the same manner as the coupling portion 501*e* of the drum driving gear 501 illustrated in FIG. 20D. A sectional view of the drum driving gear 501 taken along a line XXIC-XXIC in FIG. 21A is illustrated in FIG. 21C. Further, a partial sectional view of the coupling portion 501*e* taken along a line XXID-XXID in FIG. 21C is illustrated in FIG. 21D. FIG. 21E is a perspective view strafing only the shaft portion 501*j* of the drum driving gear 501. The groove portions 501*e*1 to 501*e*3 of the coupling portion 501*e* are arranged in the same shapes at an equidistant angle of 120° in the direction of an arrow indicated with a solid line in FIG. 21D. When the drum driving gear 501 rotates in the direction of the arrow indicated with the solid line in FIG. 21D, each of the groove portions 501*e*1 to 501*e*3 of the coupling portion 501*e* is engaged with the coupling (not illustrated) which has a convex shape to be engaged with each of the groove portions 501*e*1 to 501*e*3 and which is on the photosensitive drum 1 side, so that drive is transmitted. Also in such a configuration, the shaft portion 501*j* is provided so as to be integrally molded in the flange portion 501*h* that has the outer diameter larger than the outer diameter of the minimum inner diameter portion 501*r* of the gear portion 501*g* near the supported portion. In the flange portion 501*h*, the rotation stopper 501*m* the outer diameter of which is larger than the minimum inner diameter of the gear portion 501*g* is formed. By integrally molding the gear portion 501*g* in the flange portion 501*h* having the shaft portion 501*j* and the rotation stopper 501*m* integrally molded therein, the drum driving gear 501 is formed.

In the drum driving gear according to the present embodiment illustrated in FIGS. 21A to 21E, the area of the gear portion 501*g* formed of resin is smaller and thus the resin is less deformed, compared to the drum driving gear according to the reference example illustrated in FIGS. 20A to 20E.

A configuration in which a shaft portion integrally molded in a flange portion in a drive transmitting member transmits, to a photosensitive drum serving as a drive transmitted member, driving force from gear teeth is exemplified in the embodiments described above, but there is no limitation thereto. A configuration may be such that driving force is transmitted from a driving source to the shaft portion integral molded in the flange portion and the transmitted driving force is transmitted to a gear portion. The driving force transmitted to the gear portion is transmitted to another gear serving as a drive transmitted member. Such a configuration is also able to achieve a similar effect.

In the embodiments described above, a gear is exemplified as a drive transmitting member, but there is no limitation thereto and a similar effect is able to be obtained also by a pulley or a friction wheel.

In the embodiments described above, four process stations (process cartridges) are used as a plurality of image forming portions, but the number of image forming units in use is not limited thereto and may be appropriately set as needed.

In the embodiments described above, as a process cartridge detachably attachable to the image forming apparatus main body, a process cartridge that is integrally provided with a photosensitive drum, and a charging unit, a developing unit, and a cleaning unit that are process units acting on the photosensitive drum is exemplified. However, there is no limitation thereto. A process cartridge that is integrally provided with, in addition to the photosensitive drum, any one of the charging unit, the developing unit, and the cleaning unit may be used.

Further, in the embodiment described above, a configuration in which the process cartridge including the photosensitive drum is detachably attachable to the image forming apparatus is exemplified, but there is no limitation thereto. For example, a configuration may be such that a unit (cleaner unit) including a photosensitive drum and a unit (development unit) including a developing device are individually detachably attachable to the image forming apparatus.

In the embodiment described above, a printer is exemplified as the image forming apparatus, the disclosure is not limited thereto. For example, another image forming apparatus, such as a copier or a facsimile device, or another apparatus such as a multifunction peripheral in which functions thereof are combined may be used. By applying the disclosure to such an image forming apparatus, a similar effect is able to be obtained.

According to the disclosure, it is possible to suppress deformation of a drive transmitting member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-175395 filed Sep. 13, 2017 and Japanese Patent Application No. 2018-111277 filed Jun. 11, 2018, which are hereby incorporated by reference herein in their entirety.

What is claimed is:

1. A drive transmitting member comprising:

a first portion that is formed of a first resin and has a gear portion; and a second portion that is integrally molded with the first portion by a second resin and includes a flange portion and a shaft portion, wherein the flange portion includes a rotation stopper that comprises a plurality of convex portions and a concave portion between the convex portions and is formed at an outer periphery of the flange portion, and wherein a first length obtained by subtracting (1-1) a first radius of the inscribed circle of the first portion around the center of rotation of the gear portion from (1-2) a second radius of the circumscribed circle of the first portion around the center of rotation of the gear portion is larger than a second length obtained by subtracting (2-1) a first distance from the center of rotation of the rotation stopper to the concave portion from (2-2) a second distance from the center of rotation of the rotation stopper to a tip end of the convex portion, and the second distance is larger than the first radius so as to cover the rotation stopper with the first portion and thus to enable the rotation stopper to stop the rotation of the gear portion with respect to the flange portion.

2. The drive transmitting member according to claim 1, wherein a linear expansion coefficient of the first resin is larger than a linear expansion coefficient of the second resin.

3. The drive transmitting member according to claim 2, wherein the linear expansion coefficient of the first resin is 7.0×10-5 (/° C.) or more.

4. The drive transmitting member according to claim 1, wherein flexural strength of the first resin is smaller than flexural strength of the second resin.

5. The drive transmitting member according to claim 4, wherein the flexural strength of the first resin is 100 MPa or less.

6. The drive transmitting member according to claim 1, wherein the first resin is polyacetal (POM), and the second resin is polyphenylene sulfide (PPS).

7. The drive transmitting member according to claim 1, wherein the first radius has a length in a range of 1.3 times to 1.5 times longer than that of the second radius.

8. The drive transmitting member according to claim 1, wherein a portion of the second portion not covered with the first portion has a phase decision portion for detecting a phase of the drive transmitting member in a rotational direction.

9. The drive transmitting member according to claim 1, wherein the shaft portion has an engaging portion that is engaged with a drive transmitted member which is transmitted driving force from the gear portion.

10. A drive transmitting device comprising:

the drive transmitting member according to claim 1;

a light emitting portion that emits light; and a light receiving portion that receives the light, wherein the phase decision portion is a hole, and wherein a phase of the drive transmitting member is decided when the light emitted from the light emitting portion passes through the phase decision portion and is received by the light receiving portion.

11. A drive transmitting device comprising:

the drive transmitting member according to claim 1; and a bearing member that supports the shaft portion of the drive transmitting member, wherein the drive transmitting member is supported by the bearing member through a collar member that rotates with the shaft portion.

12. The drive transmitting device according to claim 11, wherein the collar member has, in a circumferential direction, a plurality of projections whose lengths in the axial direction are different, and the shaft portion to which the collar member is attached has, at positions corresponding to the projections, radial ribs according to the lengths of the projections in the axial direction.

13. The drive transmitting device according to claim 10, wherein the shaft portion is engaged with an image carrying member and transmits, to the image carrying member, driving force from the gear portion.

14. The drive transmitting device according to claim 13, wherein the shaft portion includes a coupling engaged with the image carrying member.

15. The drive transmitting device according to claim 14, wherein the coupling has a concave shape at a tip end engaged with the image carrying member.

16. The drive transmitting device according to claim 14, wherein the coupling has a convex shape at a tip end engaged with the image carrying member.

17. An image forming apparatus that includes a drive transmitting device which is engaged with a unit detachably attachable to an image forming apparatus main body and transmits driving force to the unit and that forms an image on a sheet, wherein the drive transmitting device according to claim 10 is included as the drive transmitting device.

18. The image forming apparatus according to claim 17, wherein the unit is a process cartridge including an image carrying member and a process unit configured to act thereon.

19. An image forming apparatus comprising:

the drive transmitting member according to claim 1, and photosensitive drum on which toner is bonded to an electrostatic latent image and a toner image is developed.

* * * * *